US005715751A

United States Patent [19]

Nobuta et al.

[11] Patent Number: 5,715,751

[45] Date of Patent: Feb. 10, 1998

[54] PRINTING PLATE SUPPORT DEVICE AND PRINTING PLATE REMOVABLY MOUNTING APPARATUS AS WELL AS METHODS OF OPERATING THE SAME

[75] Inventors: Yohsuke Nobuta, Kanagawa-ken; Yasuo Shibuya, Tokyo; Tohru Higuchi; Daisuke Nakamura, both of Kanagawa-ken, all of Japan

[73] Assignee: Kabushiki Kaisha Tokyo Kikai Seisakusho, Tokyo, Japan

[21] Appl. No.: 506,570

[22] Filed: Jul. 25, 1995

[30] Foreign Application Priority Data

Nov. 16, 1994 [JP] Japan ..... 6-281794

[51] Int. Cl.[6] ..... B41F 21/00

[52] U.S. Cl. ..... 101/415.1; 101/383

[58] Field of Search ..... 101/415.1, 477, 101/383, 216, DIG. 36, 378, 382.1

[56] References Cited

U.S. PATENT DOCUMENTS

| | | | |
|---|---|---|---|
| 5,540,151 | 7/1996 | Ruckmann et al. | 101/477 |
| 5,555,812 | 9/1996 | Ruckmann et al. | 101/477 |

FOREIGN PATENT DOCUMENTS

| | | |
|---|---|---|
| 43 31 430 A1 | 3/1994 | Germany . |
| 44 04 558 C2 | 8/1995 | Germany . |
| 58-188 657 A | 4/1983 | Japan . |
| 58-188657 | 11/1983 | Japan . |
| 62-74654 | 4/1987 | Japan . |
| 62-74 654 A | 6/1987 | Japan . |
| 1176558 | 7/1989 | Japan . |
| 1-176 558 A | 12/1989 | Japan . |
| 1-184 849 A | 8/1991 | Japan . |
| 3184849 | 8/1991 | Japan . |
| 3-67 023 B2 | 10/1991 | Japan . |
| 367023 | 10/1991 | Japan . |
| 3-71 262 B2 | 11/1991 | Japan . |
| 371262 | 11/1991 | Japan . |
| 4-363 246 A | 12/1992 | Japan . |
| 4363246 | 12/1992 | Japan . |
| 07101043 | 4/1995 | Japan . |
| 07125180 | 5/1995 | Japan . |

OTHER PUBLICATIONS

Patent abstract of DE 43 31 430, Mar. 24, 1994.

*Primary Examiner*—Ren Yan
*Attorney, Agent, or Firm*—Ronald P. Kananen

[57] ABSTRACT

There is provided a construction which comprises: a printing plate receiving means that is arranged at a position remote from the periphery of a plate cylinder for supporting a printing plate lock-up hook portion in parallel to the axis of the plate cylinder and as capable of displacement in parallel to that axis; a receiving position determining means for positioning at a predetermined position of the printing plate receiving means the printing plate lock-up hook portion mounted thereon; and a stop position determining means for stopping the printing plate receiving means at a predetermined position relative to a side end surface of the plate cylinder. The invention enables a printing plate being locked up to be positioned with an extremely high precision, yet in a short period of time, corresponding to the position where it is to be locked up, relative to an axially displaced plate cylinder.

17 Claims, 17 Drawing Sheets

PP
PP1
PP2
PP3
F
B
C
D
1
2
3
4
11a
11b
11d
12
13d
21a
21e
21g
21n
21p
21q
21s
31a
31e
31p
31u
31x
31z
41a
41b
41c
SF
HK
HL
SP
ST
PL
PC
GV
EG

FIG. 8A (1) THE PLATE CYLINDER IS ROTATED AND IS STOPPED IN A PREDETERMINED PHASE OF ROTATION.

↓

(2) ONE OF THE LOCK-UP HOOK PORTIONS OF THE PRINTING PLATE IS HOOKED ON THE PRINTING PLATE SUPPORT BAR AT THE REFERENCE POSITION WHILE THE POSITIONING ENGAGEMENT PORTION IS ENGAGED WITH THE RECEIVING POSITION DETERMING MEANS CORRESPONDING TO THE RIGHT-HAND PORTION OR THE LEFT-HAND PORTION OF THE PLATE CYLINDER TO MOUNT THE PRINTING PLATE ON THE PRINTING PLATE SUPPORT MEANS.

↓

(3) AS THE PRINTING PLATE SUPPORT BAR IS DISPLACED IN PARALLEL TO THE AXIS OF THE PLATE CYLINDER, THE STOP POSITION DETERMINING MEANS IS DISPLACED. WHEN THE STOPPER MEMBER IS IN CONTACT WITH A SIDE END SURFACE OF THE PLATE CYLINDER, THE PRINTING PLATE MOUNTED ON THE PRINTING PLATE SUPPORT MEANS IS POSITIONED RELATIVE TO THE PLATE CYLINDER.

↓

(4) THE SUCKERS OF THE PRINTING PLATE DISPLACEMENT MEANS ATTRACT AND RETAIN THE PRINTING PLATE, THE SUCKER SUPPORT STAY IS DISPLACED TO THE SIDE OF THE PLATE CYLINDER TO DISPLACE AND FEED OUT THE PRINTING PLATE, AND THE ONE LOCK-UP HOOK PORTION IS PLACED IN FRONT OF THE GROOVE OF THE PRINTING PLATE LOCK-UP MEANS. ALSO, THE STOP POSITION DETERMINING MEANS OF THE PRINTING PLATE SUPPORT MEANS IS RETURNED TO ITS INITIAL STATE.

↓

FIG. 8B (5) THE PRESSING OPERATION OF THE ROLLER MEMBER OF THE PRINTING PLATE PRESS MEANS AND THE WITHDRAWING ACTION BY THE PRINTING PLATE DISPLACEMENT MEANS CAUSE THE ONE LOCK-UP HOOK PORTION OF THE PRINTING PLATE TO BE HOOKED ON ONE EDGE OF THE GROOVE OF THE PRINTING PLATE LOCK-UP MEANS. THE PRINTING PLATE DISPLACEMENT MEANS IS RETURNED TO ITS INITIAL STATE AS IT IS.

(6) THE PLATE CYLINDER IS REGULARLY ROTATED WITH THE PRINTING PLATE PRESSED AGAINST THE PERIPHERY OF THE PLATE CYLINDER BY THE ROLLER MEMBER OF THE PRINTING PLATE OF THE PRINTING PLATE PRESS MEANS. THE ONE LOCK-UP HOOK PORTION HOOKED ON THE ONE EDGE OF THE GROOVE IS DISPLACED ALONG WITH THE PLATE CYLINDER TO CAUSE THE PRINTING PLATE TO BE WOUND ROUND THE PLATE CYLINDER.

(7) THE PLATE CYLINDER IS STOPPED FOR EACH ONE REVOLUTION WITH THE PRINTING PLATE WOUND THEREROUND. WHEN IT IS STOPPED, THE ROLLER MEMBER OF THE PRINTING PLATE PRESS MEANS KEEPS PRESSING THE REGION OF THE OTHER LOCK-UP HOOK PORTION OF THE PRINTING PLATE.

(8) THE PRINTING PLATE LOCK-UP OPERATING MEANS IS OPERATED TO OPERATE THE PRINTING PLATE LOCK-UP MEANS OF THE PLATE CYLINDER. THE OTHER LOCK-UP HOOK PORTION OF THE PRINTING PLATE IS DISPLACED BY THE HOOK MEMBER OF THE PRINTING PLATE LOCK-UP MEANS INTO A PHASE IN WHICH WHEN IT IS THRUSTED INTO THE GROOVE, THERE MAY ARISE NO INTERFERENCE THEREWITH.

FIG. 8C (9) THE OTHER LOCK-UP HOOK PORTION OF THE PRINTING PLATE IS THRUSTED INTO THE GROOVE BY THE ROLLER MEMBER OF THE PRINTING PLATE PRESS MEANS, THE HOOK MEMBER OF THE PRINTING PLATE LOCK-UP MEANS IS DISPLACED BY THE PRINTING PLATE LOCK-UP OPERATING MEANS, AND THE OTHER LOCK-UP HOOK PORTION IS HOOKED WITH THE HOOK MEMBER.

(10) THE PRINTING PLATE PRESS MEANS AND THE PRINTING PLATE LOCK-UP OPERATING MEANS ARE RETURNED TO THEIR INITIAL STATES.

FIG. 9A

(11) THE PLATE CYLINDER IS ROTATED AND IS STOPPED IN A PREDETERMINED PHASE OF ROTATION.

↓

(12) THE ROLLER MEMBER OF THE PRINTING PLATE PRESS MEANS PRESSES THE REGION OF THE OTHER LOCK-UP HOOK PORTION OF THE PRINTING PLATE THAT IS LOCKED UP ONTO THE PLATE CYLINDER.

↓

(13) THE PRINTING PLATE LOCK-UP OPERATING MEANS IS OPERATED TO OPERATE THE PRINTING PLATE LOCK-UP MEANS OF THE PLATE CYLINDER, THEREBY RELEASING THE HOOKING OF THE OTHER LOCK-UP HOOK PORTION WITH THE HOOK MEMBER. THEN, THE OTHER LOCK-UP HOOK PORTION OF THE PRINTING PLATE IS PROJECTED OUT FROM THE GROOVE BY THE ELASTICITY OF THE PRINTING PLATE.

↓

(14) AFTER THE OTHER LOCK-UP HOOK PORTION OF THE PRINTING PLATE IS FED OUT FROM THE GROOVE, THE PRINTING PLATE LOCK-UP OPERATING MEANS RETURNS THE PRINTING PLATE LOCK-UP MEANS TO ITS INITIAL STATE WHILE THE PRINTING PLATE LOCK-UP OPRATING MEANS ITSELF IS RETURNED TO ITS INITIAL STATE.

↓

(15) THE PLATE CYLINDR IS REVERSELY ROTATED, CAUSING THE PRINTING PLATE TO BY GRADUALLY REMOVED AWAY FROM THE PERIPHERY OF THE PLATE CYLINDER.
THE LEADING OTHER LOOK-UP HOOK PORTION ARRIVES AT THE PRINTING PLATE SUPPORT BAR OF THE PRINTING PLATE SUPPORT MEANS AND IS GUIDED INTO AN OUTLET SIDE BY THE PRINTING PLATE SUPPORT BAR.

↓

FIG. 9B

(16) IN THE MEAN TIME, THE ROLLER MEMBER OF THE PRINTING PLATE THRUST MEANS CONTINUES TO THRUST THE PRINTING PLATE BROUGHT ABOUT AGAINST THE PERIPHERY OF THE PLATE CYLINDER. BUT AFTER THE OTHER LOCK-UP HOOK PORTION ARRIVES AT THE PRINTING PLATE SUPPORT BAR, THAT ROLLER MEMBER IS RETURNED TO ITS INITIAL STATE AT A SUITABLE TIMING.

(17) AFTER THE PLATE CYLINDER IS FURTHER REVERSELY ROTATED TO EXCEED ITS ONE REVOLUTION, THE ONE LOCK-UP HOOK PORTION OF THE PRINTING PLATE IS RELEASED FROM THE ONE EDGE OF THE GROOVE WHILE A PHASE OF ROTATION IS BEING REACHED IN WHICH THE PRINTING PLATE LOCK-UP MEANS LIES BELOW THE PRINTING PLATE SUPPORT BAR.

(18) AFTER THE AFORE-MENTIONED PHASE OF ROTATION IS REACHED IN WHICH THE LOCK-UP HOOK PORTION OF THE PRINTING PLATE IS RELEASED FROM THE ONE EDGE OF THE GROOVE, THE REVERSE ROTATION OF THE PLATE CYLINDER IS STOPPED WHEN IT REACHES A SUITABLE PHASE OF ROTATION.

PRINTING PLATE SUPPORT DEVICE AND PRINTING PLATE REMOVABLY MOUNTING APPARATUS AS WELL AS METHODS OF OPERATING THE SAME

BACKGROUND OF THE INVENTION

1. Technical Field of the Invention

The present invention relates to a printing plate support device for setting a printing plate at a predetermined position where the printing plate is removably mounted on a plate cylinder of a rotary press and a printing plate removably mounting apparatus as well as methods of operating the device and the apparatus.

2. Description of the Prior Art

In the field of rotary presses, such as a rotary press for newspapers, in which a plurality of printing plates are locked up onto a single plate cylinder, there have been known a variety of structures for mounting a printing plate on the plate cylinder and removing and discharging the printing plate mounted on the plate cylinder thereform. Such structures are disclosed, for example, in Japanese Examined Patent Publication No. 3-67023 and No. 3-71262 and Japanese Unexamined Patent Publication Nos. 58-188657, 62-74654, 1-176558, 3-184849 and 4-363246.

Of these, the structures described in No. 3-67023 and others, except No. 3-71262, No. 58-188657 and No. 3-184849 above, are each designed to have a displacement mechanism in which a basic body including an arm portion by which a printing plate retaining portion for removably mounting a printing plate on a plate cylinder is provided at an open end is so arranged as to be displaceable in parallel to an axis of the plate cylinder along a rail. The arm portion is provided with a plurality of rotary mechanisms and a linear-drive mechanism such that the afore-mentioned printing plate retaining portion can be displaced at least between a region in which the printing plate is removably mounted on the plate cylinder opposed to the displacing basic body and a position of the withdrawal that lies in the vicinity of the basic body. Further, the respective mechanism for each of the displacement, rotation and linear-drive needs to be controlled for its individual operation so that they may be operated in their mutually associated mechanism by high-precision control means in order to lock up the printing plate onto the plate cylinder by means of the printing plate retaining portion.

On the other hand, the structures described in No. 3-71262 and No. 58-188657 above are designed each to be provided corresponding to a printing plate lock-up position for a plate cylinder and to eliminate the need to be displaced in parallel to the axis of the plate cylinder and hence to eliminate the need for a displacement mechanism as disclosed in No. 3-67023 and others above. In these structures, however, a printing plate retaining portion that performs the printing plate lock-up operation for a plate cylinder is provided at an open end while an arm portion that comprises a large, a a medium and a small part is utilized. Accordingly, for the printing plate to be locked up onto the plate cylinder, the afore-mentioned rotary mechanisms are respectively operated in a functional association thereof.

Also, the structure described in No. 3-184849 above is so designed that respective printing portions may be stacked one upon another in the direction of their height and that they are disposed outside of a space across which are juxtaposed a pair of rotary presses. Also provided are a displacement mechanism such that the base body including the arm portion by which the printing plate retaining portion that performs the printing plate lock-up operation for the plate cylinder may be displaced along a vertically mounted guide, and a rotary mechanism which can be rotated about the center line of the afore-mentioned guide. The arm portion is provided with a plurality of rotary mechanisms so that the afore-mentioned printing plate retaining portion can be displaced at least between the operating region for removably mounting the printing plate for each plate cylinder in front of the aforementioned space of the two rotary presses as provided. Further, the respective mechanism for each of the displacement and the rotation needs to be controlled for its individual operation so that they may be operated in their mutually associated mechanism by high-precision control means in order to lock up the printing plate onto the plate cylinder by means of the printing plate retaining portion.

At this point, it should be noted that the printing plate lock-up apparatus described in any of the patent publications mentioned above has unexceptionably been large in the amount of operation for the arm portion or the base body including the arm portion which must be a heavy body, and has so had its positioning accuracy which tends to become relatively low when the printing plate is locked up onto the plate cylinder. In addition, a large energy has been required in it to enable the heavy body to be operated and hence has been a cause that unavoidably increases its running cost. Furthermore, a need has arisen to provide a sufficient measure in order to ensure and maintain the security for an operator in the operating zone and thus has been a cause which increases the manufacturing cost.

Also, in these constructions, since the arm portion in which the printing plate retaining portion is provided is used to removably mount the printing plate onto the plate cylinder, a relatively complex associated operation has been required that resembles a manual operation by an operator. This has necessitated a complicated mechanism and a highly efficient control means, and accordingly has brought about a cause that again increases the manufacturing cost. Also, for a constantly stable operation to be obtained, a relatively frequent maintenance task has been required, thus, here again, pushing up the running cost.

In addition, a relatively large amount of time has been required to engage in the printing plate lock-up stage according to this relatively complex associated operation.

Moreover, in such a printing plate lock-up apparatus, since the printing plates must be taken one by one from a stock portion for them for their lock-up operation onto the plate cylinder, much time has been expended to lock them up onto the single plate cylinder. Hence, many contrivances have been required in order to enhance the operability of a rotary press machine.

SUMMARY OF THE INVENTION

With the foregoing prior-art problems taken into account, it is an important object of the present invention to simplify and to make lighter the operating mechanism of the conventional printing plate removably mounting apparatus, as well as to simplify its operation and to make its control easier.

It is another important object of the present invention to reduce the amount of operations involved in the conventional printing plate removably mounting apparatus.

It is a further important object of the present invention to enhance the positioning accuracy for such an apparatus when a printing plate is locked up onto a plate cylinder.

It is still a further object of the present invention to enable a predetermined positioning to be accomplished corresponding also to a variation in displacement of the plate cylinder in its axial direction.

It is yet a further object of the present invention to enhance the operability of a rotary press machine with a reduced manufacturing cost and a decreased running cost and yet with a reduced time required for removably mounting a printing plate onto a plate cylinder.

It is an important object of the present invention to provide an improved printing plate support devise whereby the afore-mentioned conventional problems in the art of a rotary press machine can be obviated.

It is another important object of the present invention to provide an improved printing plate removably mounting apparatus whereby the afore-mentioned conventional problems in the art of a rotary press machine can be obviated.

It is a further important object of the present invention to provide highly efficient methods of operating the devise and the apparatus which are mentioned above.

In accordance with the present invention, there is provided, in a first aspect thereof, in an apparatus for locking up a printing plate in a rotary press having a plate cylinder which is displaceable in its axial direction, is capable of stopping in a predetermined phase of rotation and is provided on its periphery and in parallel to its axis with a printing plate lock-up means, in which the said printing plate is formed with a lock-up hook portion capable of being hooked on and off the printing plate lock-up means, a device for supporting the printing plate comprises:

a printing plate receiving means which is located at a position spaced from the said periphery of the said plate cylinder by a predetermined distance and is formed along the said plate cylinder with a reference site for defining the said lock-up hook portion of the said printing plate in parallel to the axis of the said plate cylinder and, when driven, is displaceable in parallel to the said axis of the plate cylinder;

a receiving position determining means which is so disposed as to be engageable with a positioning engagement portion that is provided at a predetermined position of the said lock-up hook portion of the printing plate mounted on the said printing plate receiving means for positioning the said printing plate at a predetermined portion of the said printing plate receiving means; and a stopping position determining means which is disposed at a side portion of the said printing plate receiving means, when driven is displaceable between a position that is opposed to a side end surface of the said plate cylinder and a position that is otherwise, and is adapted to abut on the said side end surface of the plate cylinder according to a displacement of the said printing plate receiving means for stopping the printing plate receiving means at a preselected position relative to the said plate cylinder.

The present invention also provides, in a second aspect thereof, in a rotary press adapted to lock up a printing plate and having a plate cylinder that is displaceable in an axial direction, is rotatable in both a normal drive and a reverse drive, is capable of being stopped in a predetermined phase of rotation, and is formed on its periphery and in parallel to its axis with a printing plate lock-up means, in which the said printing plate being formed with a plurality of lock-up hook portions capable of being hooked on and off the said printing plate lock-up means, an apparatus for removably mounting the printing plate on the plate cylinder comprises:

a printing plate support means disposed at a position along the said plating cylinder and spaced from a periphery thereof by a predetermined distance for supporting the said printing plate in a predetermined positional relationship with the said plate cylinder such that a said printing plate lock-up hook portion may lie in parallel to the axis of the said plate cylinder and be matched with an axial displacement of the said plate cylinder while mounting the said printing plate on the said plate cylinder in such a manner that the printing plate when detached therefrom can be guided towards an outlet direction;

a printing plate displacement means which is disposed in the vicinity of the said printing plate supported on the said printing plate support means and is capable of retaining the said printing plate supported by the said printing plate support means for mounting the said printing plate so as to freely advance at least one of the said lock-up hook portions so that the said printing plate can be fed out towards the said plate cylinder in accordance with a surface generally in contact with the said periphery of the plate cylinder;

a printing plate press means disposed in the vicinity and in front of the periphery of the said plate cylinder for being displaced in and out of contact with the said periphery of the plate cylinder, displacing a said printing plate lock-up hook portion towards the said printing plate lock-up means for the said plate cylinder and pressing the said printing plate against the said periphery of the plate cylinder to mount the said printing plate so as to be capable of wound round the said plate cylinder with a rotation thereof; and a printing plate lock-up operating means disposed in the vicinity of said printing plate lock-up means of the said plate cylinder at a stoppage thereof in the predetermined phase of rotation for operating the said printing plate lock-up means of the said plate cylinder that is stopped in the said phase of rotation.

The said printing plate support means in the printing plate removably mounting apparatus in accordance with the present invention may also preferably comprise:

a printing plate receiving means which is located at a position spaced from the said periphery of the said plate cylinder by a predetermined distance and is formed along the said plate cylinder with a reference site for defining the said lock-up hook portion of the said printing plate in parallel to the axis of the said plate cylinder and, when driven, is displaceable in parallel to the said axis of the plate cylinder;

a receiving position determining means which is so disposed as to be engageable with a positioning engagement portion that is provided at a predetermined position of the said lock-up hook portion of the printing plate mounted on the said printing plate receiving means for positioning the said printing plate at a predetermined position of the said printing plate receiving means; and a stopping position determining means which is disposed at a side portion of the said printing plate receiving means, when driven is displaceable between a position that is opposed to a side end surface of the said plate cylinder and a position that is otherwise, and is adapted to abut on the said side end surface of the plate cylinder according to a displacement of the said printing plate receiving means for stopping the printing plate receiving means at a preselected position relative to the said plate cylinder.

The present invention also provides, in a further aspect thereof, a method of attaching a printing plate onto a plate cylinder in a rotary press having a printing plate lock-up means, a printing plate lock-up operating means, a printing plate support means, a printing plate press means, a printing plate displacement means, a receiving position determining means and a stop position determining means, which method comprises the steps of:

(a) providing the printing plate with a pair of lock-up hook portions and a positioning engagement portion;

(b) providing the said printing plate lock-up means with a hook member and a groove;

(c) providing the printing plate support means with a printing plate support bar;

(d) providing the said stop position determining means with a stopper member;

(e) providing the said printing plate press means with a roller member;

(f) providing the said printing plate displacement means with a plurality of suckers and a sucker support stay;

(g) rotating the said plate cylinder and stopping its rotation in a predetermined phase of rotation;

(h) hooking one of the said lock-up hook portions on the said printing plate support bar at a reference site while engaging the said positioning engagement portion with the said receiving position determining means corresponding to a right-hand side portion or a left-hand side portion of the said plate cylinder so as to mount the said printing plate on the said printing plate support means;

(i) displacing the said printing plate support bar in parallel to an axis of the said cylinder while displacing the said stop position determining means, and positioning, relative to the said plate cylinder, the said printing plate mounted on the said printing plate support means when the said stopper member is brought into contact with a side end surface of the said plate cylinder;

(j) attracting and retaining the said printing plate by means of the said suckers, displacing the said sucker support stay to a side of the said plate cylinder so as to displace and feed out the said printing plate, placing the said one lock-up portion in front of the said groove, and returning the said stop position determining means to an initial state thereof;

(k) actuating a pressing operation of the said roller member and a withdrawal action for the printing plate by the said printing plate displacement means to cause the said one lock-up hook portion to be hooked on one edge of the said groove, and returning the said printing plate displacement means to an initial state thereof;

(l) regularly rotating the said plate cylinder with the said printing plate pressed against a periphery thereof by the said roller member and displacing, along with the rotation of said plate cylinder, the said one lock-up hook portion hooked on the said one edge of the groove to cause the said printing plate to be wound round the said plate cylinder;

(m) stopping the said plate cylinder for each one revolution thereof while continuingly pressing a region of the other of the said lock-up hook portions with the said printing plate press means;

(n) operating the printing plate lock-up operating means to operate the said printing plate lock-up means, and displacing the said other lock-up hook portion by means of the said hook member into a phase in which when it is thrusted into the said groove, there may arise no interference therewith;

(o) thrusting the said other lock-up portion into the said groove by means of the said roller member, displacing the said hook member by means of the said printing plate lock-up operating means, and hooking the said other lock-up hook portion with the said hook member; and (p) returning the said printing plate press means and the said printing plate lock-up operating means to their respective initial states.

The present invention further provides, in another aspect thereof, a method of detaching a printing plate from a plate cylinder in a rotary press having a printing plate lock-up means, a printing plate lock-up operating means, a printing plate press means and a printing plate support means, which method comprises the steps of:

(a) providing the printing plate with a pair of lock-up hook portions;

(b) providing the said printing plate lock-up means with a hook member and a groove;

(c) providing the said printing plate support means with a printing plate support bar;

(d) providing the said printing plate press means with a roller member;

(e) rotating the said plate cylinder and stopping its rotation in a predetermined phase of rotation;

(f) pressing, with the said roller member, a region of a second of the said lock-up hook portions of the said printing plate that is locked up onto the said plate cylinder;

(g) operating the said printing plate lock-up operating means to operate the said printing plate lock-up means so as to release a hooking of the said second lock-up hook portion with the said hook member, and causing the said second lock-up hook portion to be projected out from the said groove by an elasticity of the said printing plate;

(h) thereafter, returning, with the said printing plate lock-up operating means, the said printing plate lock-up means to an initial state thereof while returning the said printing plate lock-up operating means itself to an initial state thereof;

(i) reversely rotating the said plate cylinder to cause the said printing plate to be gradually removed away from a periphery of the said plate cylinder, and causing the said second lock-up hook portion which 1s leading to arrive at the said printing plate support bar and to be guided into an outlet side by the said printing plate support bar;

(j) concurrently with the step (i), continuingly pressing, with the said roller member, the said printing plate brought about against the said periphery of the plate cylinder, and thereafter, returning the said roller member to an initial state thereof;

(k) after the said plate cylinder is further reversely rotated to exceed its one revolution, releasing a first of the said lock-up hook portions from one edge of the said groove while a phase of rotation is being reached in which the said printing plate lock-up means lies below the said printing plate support bar; and (l) after the said phase of rotation is reached in which the said first lock-up hook portion is released from the one edge of the said groove, stopping the reverse rotation of the said plate cylinder when it reaches a suitable phase of rotation.

The present invention still further provides, in yet another aspect thereof, a method of operating a printing plate removably mounting apparatus with a plate cylinder in a rotary press having a printing plate lock-up means, a printing plate lock-up operating means, a printing plate support means, a printing plate press means, a printing plate displacement means, a receiving position determining means and a stop position determining means, which method comprises the steps of:

(a) providing a printing plate with a pair of lock-up hook portions and a positioning engagement portion;

(b) providing the said printing plate lock-up means with a hook member and a groove;

(c) providing the printing plate support means with a printing plate support bar;

(d) providing the said stop position determining means with a stopper member;

(e) providing the said printing plate press means with a roller member;

(f) providing the said printing plate displacement means with a plurality of suckers and a sucker support stay;

(g) rotating the said plate cylinder and stopping its rotation in a predetermined phase of rotation;

(h) hooking a first of the said lock-up hook portions on the said printing plate support bar at a reference site while engaging the said positioning engagement portion with the said receiving position determining means corresponding to a right-hand side portion or a left-hand side portion of the said plate cylinder so as to mount the said printing plate on the said printing plate support means;

(i) displacing the said printing plate support bar in parallel to an axis of the said cylinder while displacing the said stop position determining means, and positioning, relative to the said plate cylinder, the said printing plate mounted on the said printing plate support means when the said stopper member is brought into contact with a side end surface of the said plate cylinder;

(j) attracting and retaining the said printing plate by means of the said suckers, displacing the said sucker support stay to a side of the said plate cylinder so as to displace and feed out the said printing plate, placing the said one lock-up portion in front of the said groove, and returning the said stop position determining means to an initial state thereof;

(k) actuating a pressing operation of the said roller member and a withdrawal action for the printing plate by the said printing plate displacement means to cause the said first lock-up hook portion to be hooked on one edge of the said groove, and returning the said printing plate displacement means to an initial state thereof;

(l) regularly rotating the said plate cylinder with the said printing plate pressed against a periphery thereof by the said roller member and displacing, along with the rotation of said plate cylinder, the said first lock-up hook portion hooked on the said one edge of the groove to cause the said printing plate to be wound round the said plate cylinder;

(m) stopping the said plate cylinder for each one revolution thereof while continuingly pressing a region of a second of the said lock-up hook portions with the said printing plate press means;

(n) operating the printing plate lock-up operating means to operate the said printing plate lock-up means, and displacing the said other lock-up hook portion by means of the said hook member into a phase in which when it is thrusted into the said groove, there may arise no interference therewith;

(o) thrusting the said second lock-up portion into the said groove by means of the said roller member, displacing the said hook member by means of the said printing plate lock-up operating means, and hooking the said second lock-up hook portion with the said hook member;

(p) returning the said printing plate press means and the said printing plate lock-up operating means to their respective initial states;

(q) rotating the said plate cylinder and stopping its rotation in a predetermined phase of rotation;

(r) pressing, with the said roller member, a region of the said second lock-up hook portion of the said printing plate that is locked up onto the said plate cylinder;

(s) operating the said printing plate lock-up operating means to operate the said printing plate lock-up means so as to release a hooking of the said second lock-up hook portion with the said hook member, and causing the said second lock-up hook portion to be projected out from the said groove by an elasticity of the said printing plate;

(t) thereafter, returning, with the said printing plate lock-up operating means, the said printing plate lock-up means to an initial state thereof while returning the said printing plate lock-up operating means itself to an initial state thereof;

(u) reversely rotating the said plate cylinder to cause the said printing plate to be gradually removed away from a periphery of the said plate cylinder, and causing the said second lock-up hook portion which is leading to arrive at the said printing plate support bar and to be guided into an outlet side by the said printing plate support bar;

(v) concurrently with the step (u), continuingly pressing, with the said roller member, the said printing plate brought about against the said periphery of the plate cylinder, and thereafter, returning the said roller member to an initial state thereof;

(w) after the said plate cylinder is further reversely rotated to exceed its one revolution. releasing the said first lock-up hook portion of the printing plate from the said one edge of the groove while a phase of rotation is being reached in which the said printing plate lock-up means lies below the said printing plate support bar; and (x) after the said phase of rotation is reached in which the said first lock-up hook portion is released from the one edge of the said groove, stopping the reverse rotation of the said plate cylinder when it reaches a suitable phase of rotation.

According to the printing plate support device of the foregoing construction, first of all, i.e. for the reason that by means of the reference site for defining the lock-up hook portion in parallel to the axis of the plate cylinder, the lock-up hook portion may be defined in parallel to the axis of the plate cylinder and the positioning engagement portion disposed at a predetermined position of the lock-up hook portion may be engaged with the receiving position determining means disposed on the printing plate catching means, the printing plate may be located at a predetermined position of the printing plate receiving means. The printing plate may then be mounted on the printing plate receiving means by a suitable means or by way of a manual operation.

Subsequently, the printing plate receiving means may be driven and remain displaced until the stop position determining means disposed in parallel to the axis of the plate cylinder and at the side portion of the printing plate receiving means reaches the maximum axially displaceable position at which the side end portion of the plate cylinder may be turned up aside.

It follows that the stop position determining means may be driven and displaced to the position which is opposed to the side end surface of the plate cylinder.

Further, the printing plate receiving means may be driven and remain displaced until it is brought into contact with the side end surface which may be in parallel to the axis of the plate cylinder and with which the stop position determining means may be juxtaposed. As a result of its contact with the side end surface of the plate cylinder with which the stop position determining means is juxtaposed, the printing plate receiving means may be stopped, holding its predetermined positional relationship with the plate cylinder.

Also, according to the printing plate removably mounting apparatus of the foregoing construction, a mention may first be made of the printing plate lock-up. The plate cylinder may be stopped in a predetermined phase of rotation, that is, in a phase in which the printing plate lock-up means becomes, as will be described hereinafter, capable of being hooked off with one of the lock-up hook portions for the printing plate that is being fed out while the printing plate may be supported on the printing plate support means by defining its lock-up hook portion in parallel to the axis of the plate cylinder, locating it at a predetermined receiving position, and then mounting it on the printing plate support means by using a suitable means or by way of a manual operation.

When this printing plate removably mounting apparatus is equipped with the printing plate support means of the foregoing construction as a printing plate support means used therein, the plate cylinder may be stopped ill a phase as described above while the printing plate may be supported on the printing plate support means as a result of the fact that the lock-up hook portion is defined in parallel to the axis of the plate cylinder by the reference site adapted to define the lock-up hook portion in parallel to the axis of the plate cylinder and that the position determining engagement portion disposed at a predetermined position of a said lock-up hook portion is engaged with the receiving position determining means disposed on the printing plate receiving means so as to be located at a predetermined position of the printing plate receiving means and is then mounted on the printing plate support means by a suitable means or by way of a manual operation.

Subsequent to the above, the printing plate displacement means may hold the printing plate supported on the printing plate support means and may then freely advance at least one of the lock-up hook portions so as to feed out the printing plate by a predetermined amount towards the plate cylinder, that is, until the one of the lock-up hook portions is brought into a point of its opposition to the printing plate lock-up means for the plate cylinder that remains stopped with an afore-mentioned predetermined phase of rotation.

Subsequently, one of the lock-up for hook portion for the printing plate may be pressed by the printing plate press means towards the printing plate lock-up means and may then be hooked on the printing plate lock-up means by an interaction between a withdrawal operation by way of the printing plate displacement means and a displacement operation towards a suitable direction by way of the printing plate press means.

Still subsequently, a suitable position of the printing plate may be pressed by the printing plate press means against the peripheral surface of the plate cylinder to cause the printing plate to be wound round the plate cylinder by rotating the plate cylinder in the normal direction. Also, the printing plate displacement means may be returned to its original position. And, the plate cylinder having the printing plate wound thereround may then be stopped in a predetermined phase of rotation, that is, in a phase in which the other of the lock-up hook portions for the printing plate can be opposed to the printing plate lock-up means adapted to hook the same.

When the plate cylinder is stopped, the printing plate lock-up means adapted to hook the other lock-up hook portion for the printing plate may be operated into a preparatory hooking state in which the other lock-up hook portion can be hooked while the printing plate press means may be displaced to press the other lock-up hook portion against the printing plate lock-up means. When this pressing operation is completed, the printing plate lock-up operating means may, reversely to the above, be adapted to operate the printing plate lock-up means that lies in a hooking preparatory state, to hook the other lock-up hook portion for the printing plate, thereby locking up the printing plate onto the plate cylinder.

When the printing plate is to be detached, the plate cylinder may be stopped in a predetermined phase of rotation, that is, in a phase in which the printing plate lock-up means that hooks the other lock-up hook portion of the printing plate can be operated by the printing plate lock-up operating means, for example, in a phase which is the same as that in which the other lock-up hook portion of the printing plate is hooked by the printing plate lock-up means in the afore-mentioned lock-up operation for the printing plate.

Subsequently, the printing plate press means may press those sites which are in the vicinity of the other lock-up hook portion of the printing plate against the peripheral surface of the plate cylinder while the printing plate lock-up means may be operated by the printing plate lock-up operating means into a hooking preparatory state in the afore-mentioned lock-up for the printing plate.

When this takes place, the hooking state between the operated printing plate lock-up means and the other lock-up hook portion may be released and the printing plate may be detached from the peripheral surface of the plate cylinder by the fact that the side in which the other lock-up hook portion lies may leap up rather than the site which has been pressed by the printing plate press means, due to a resilient action of the printing plate.

In this state, the plate cylinder may be reversely rotated to gradually detach the printing plate from the peripheral surface of the plate cylinder. The printing plate detached from the peripheral surface as the other lock-up hook portion reaches the printing plate support means may be moved away from the plate cylinder by the upper end of the printing plate support means with its leading end constituted by that other lock-up hook portion, and thus be guided into an outlet direction.

Further, the reversed rotation of the plate cylinder may be continued so that the printing plate lock-up means on which one of the lock-up hook portions is hooked may surpass the stopping phase of the plate cylinder in the afore-mentioned lock-up for the printing plate. The hooking state between the one of the lock-up hook portions and the printing plate lock-up means may thereby be released to complete the detachment of the printing plate from the plate cylinder. It is also preferable that in a suitable phase of the reversed rotation of the plate cylinder, the printing plate press means should be detached from the printing plate to release the printing plate from its press onto the peripheral surface of the plate cylinder.

BRIEF DESCRIPTION OF THE DRAWINGS

The present invention will be understood more fully from the detailed description given hereinafter and from the accompanying drawings of certain preferred embodiments of the present invention, which, however, should not be taken to be limitative to the invention, but are for an explanation and understanding thereof only.

In the drawings:

FIGS. 8A through 8C are a flow chart illustrating a lock-up operation for mounting the printing plate onto the plate cylinder in the embodiment shown in FIGS. 1A through 1C;

FIGS. 9A and 9B are a flow chart illustrating a removal operation for detaching the printing plate from the plate cylinder in the embodiment shown in FIGS. 1A through 1C;

DESCRIPTION OF THE PREFERRED EMBODIMENT

Figures 1A, 1B, 1C:
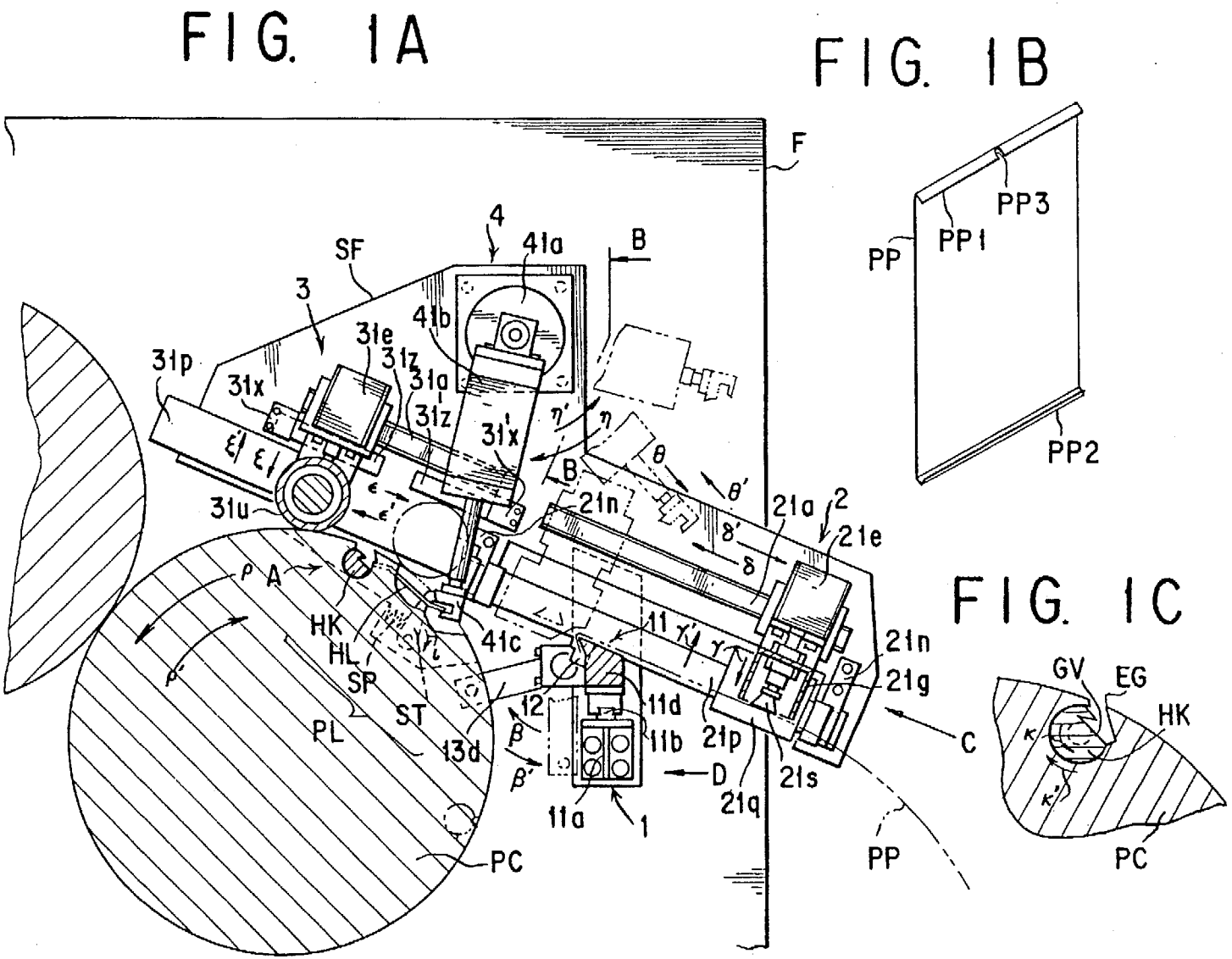
FIG. 1A is a cross-sectional view diagrammatically illustrating the entire construction of a certain embodiment according to present invention.
FIG. 1B is a perspective view diagrammatically illustrating a printing plate that may be used in the embodiment as shown in FIG. 1A and according to the present invention.
FIG. 1C is an enlarged cross-sectional view diagrammatically illustrating a portion of the embodiment as shown by the arrow A in FIG. 1A.

The present invention will be discussed hereinafter for a certain preferred embodiment and embodiments thereof with reference to the accompanying drawings. In the following description, numerous specific details are set forth in order to provide a thorough understanding of the present invention. It would be obvious, however, to a person skilled in the art that the present invention may be practiced without those specific details. In other instances, a well-known structure is not shown in detail in order not to unnecessarily obscure the essences of the present invention.

While the present invention relates in part to a printing plate lock-up device and a printing plate removably mounting apparatus, it should also be noted that since the printing plate support device is intended to correspond to the printing plate support means in the printing plate removably mounting apparatus, the explanation of the printing plate support means in the printing plate removably mounting apparatus hereinbelow also represents an explanation of the printing plate support device.

Now, referring to FIGS. 1A through 7, there is shown a printing plate removably mounting apparatus that embodies one aspect of the present invention. The printing plate removably mounting apparatus shown is provided for each plate cylinder PC in a rotary press and comprises a printing plate support means 1, a printing plate displacement means 2, a printing plate press means 3 and a printing plate lock-up operating means 4.

In the embodiment shown in FIG. 1A, the printing plate support means 1 is adapted to support a printing plate PP and is provided with a printing plate receiving means 11 for supporting the printing plate PP at a position which corresponds to the plate cylinder PC so that one PP1 of lock-up hook portions PP1 and PP2 (see FIG. 1B) foldedly formed in parallel to each other at a pair of sides (e.g. an upper side and a lower side), respectively, of the printing plate PP may be arranged to be in parallel to the axis of the plate cylinder PC (see FIGS. 1A, 4, 5 and 7).

The printing plate receiving means 11 is mounted to a pair of sub-frame SF and SF which are secured to a pair of frames F and F, respectively, at both sides of a rotary press. This is shown with respect to the frame at one side in each of the Figures except FIG. 7.

More specifically, the sub-frames SF and SF have mounted respectively thereon, via a pair of brackets **11*a* and 11*a*, a pair of guide rails 11*b* and 11*b* which extend in parallel to each other and to the axis of the plate cylinder PC and which, in turn, have respectively secured thereto a pair of displacement members 11*c* and 11*c* that are displaced along the guide rails 11*b* and 11*b*, respectively. Secured to these displacement members 11*c* and 11*c* is a printing plate support bar 11*d* which is displaced, integrally with the displacement members 11*c* and 11*c*, along the guide rails 11*b* and 11*b***.

Figure 4:
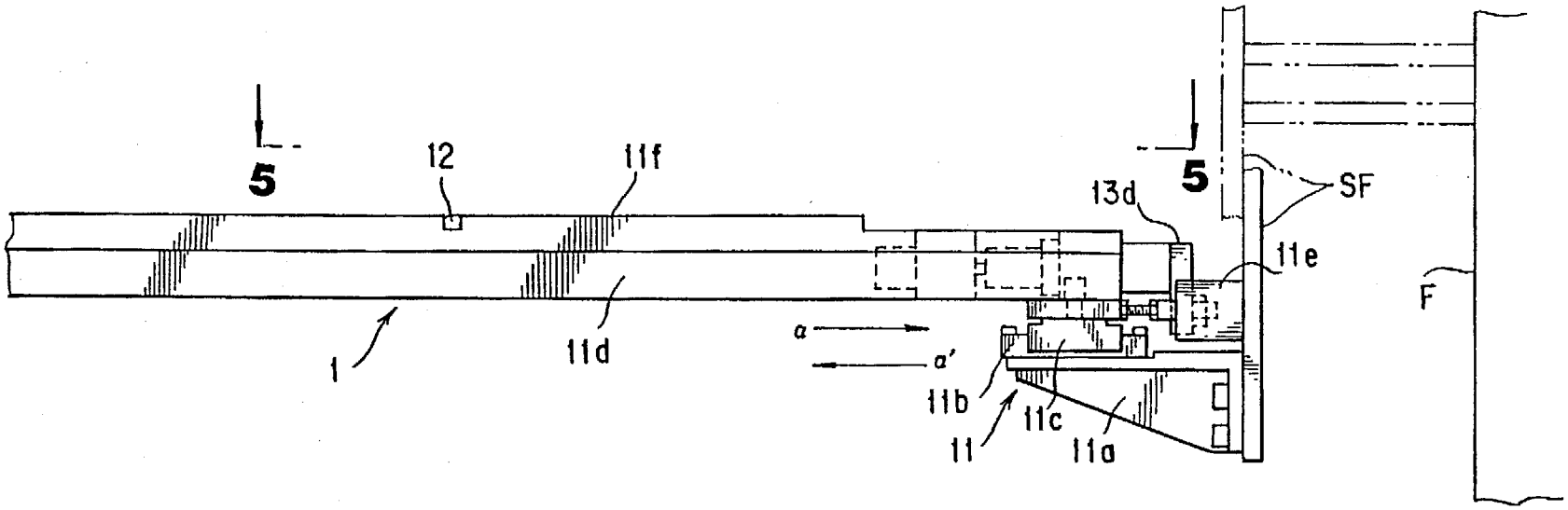
FIG. 4 is a diagrammatic view illustrating a portion of the embodiment as seen in the direction shown by the arrow D in FIG. 1A.
Figure 5:
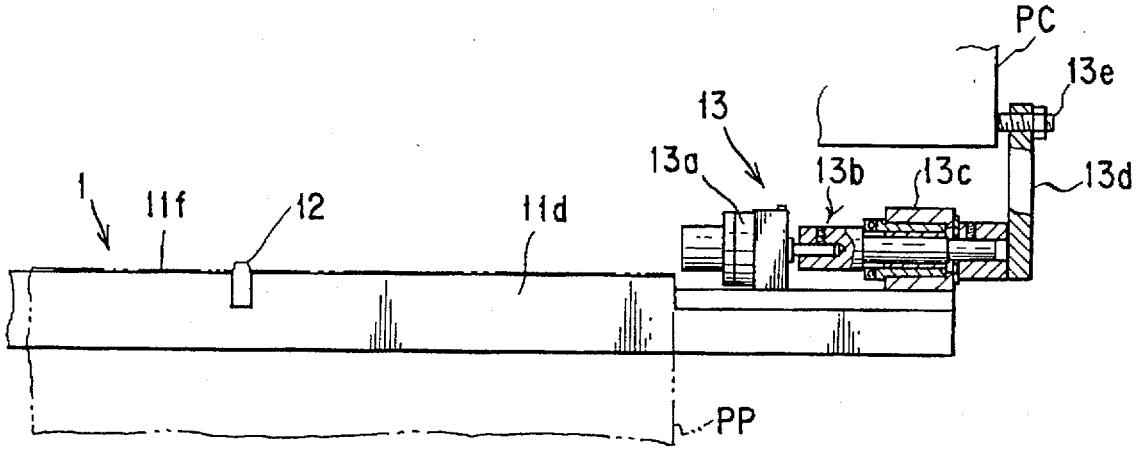
FIG. 5 is a diagrammatic view illustrating a portion of the embodiment as taken at E—E and as seen in the direction of the arrows in FIG. 4.
Figure 6:
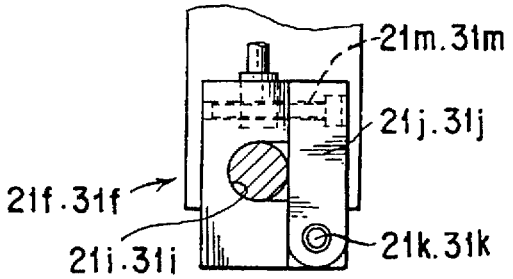
FIG. 6 is a diagrammatic view of a portion of the embodiment as taken at G—G and as seen in the direction shown by the arrows in FIGS. 2 and 3.
Figure 7:
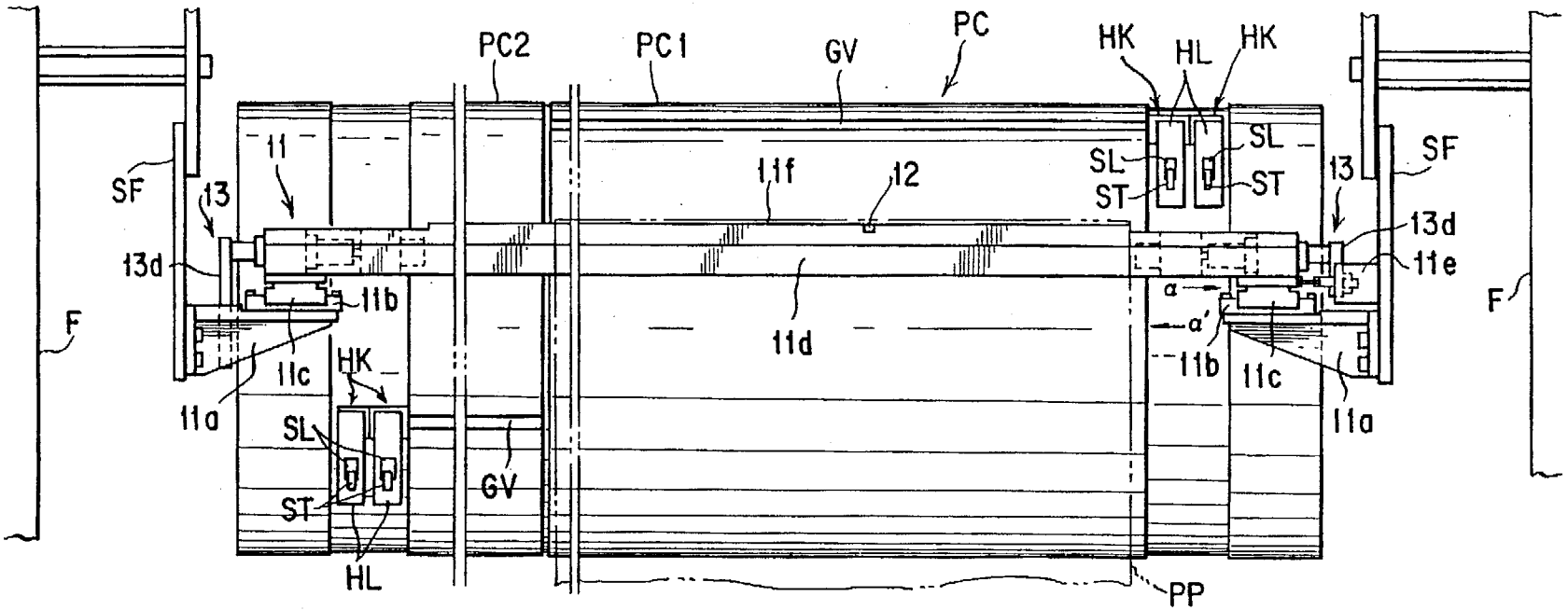
FIG. 7 is a diagrammatic view illustrating a portion of the embodiment as seen in the direction shown by the arrow D in FIG. 1A with a positional relationship with a plate cylinder between the frames at both sides.

Also, secured to either one of the sub-frames SF at a site that is opposed to a side end of one displacement member **11*c* is a hydraulic cylinder 11*e* which is so operated that its piston rod may be displaced in the directions as shown by the arrows α and α' in FIGS. 4 and 7, respectively. The piston rod of this hydraulic cylinder 11***e* is connected to one side end of the afore-mentioned one displacement member 11*c*.

Further, at a position at which the afore-mentioned printing plate support bar 11*d* is juxtaposed with the plate cylinder PC there is arranged an edge-shaped reference site 11*f* on which the one lock-up hook portion PP1 is capable of being hooked for defining the one lock-up hook portion PP1 to be in parallel to the axis of the plate cylinder PC when it is so hooked. In addition, there is arranged at a suitable position a sensing means (not shown) for detecting a printing plate PP as supported by the printing plate support bar 11*d*.

On the other hand, the printing plate receiving means 11 is provided with a receiving position determining means 12 that is designed to define a receiving position on the printing plate receiving means 11 for a printing plate PP as mounted thereon.

More specifically, the reference site 11*f* of the afore-mentioned printing plate receiving bar 11*d* is formed with the receiving position determining means 12 with which a recessed positioning portion PP3 (see FIG. 1B) formed at a predetermined position of the one lock-up hook portion PP1 for a printing plate PP is engaged for positioning the printing plate PP at a predetermined site of the printing plate support bar 11*d*.

Furthermore, the printing plate receiving means 11 on the other hand is provided with a stop position determining means 13 (see FIG. 5) that is designed to stop the printing plate receiving means 11 when it has a predetermined positional relationship with the plate cylinder PC in accordance with a displacement of the plate cylinder PC in its axial direction.

More specifically, the end portion of a site of the afore-mentioned printing plate support bar 11*d* in front of the periphery of the plate cylinder PC has secured thereto a rotary actuator 13*a* whose output shaft is rotated by a predetermined angle in the directions as shown by the arrows β and β' in FIG. 1A, respectively, and a bearing block 13*c* which supports an intermediate shaft 13*b* so that the latter may have a common center to the output shaft of the rotary actuator 13*a*.

Also, one end of the afore-mentioned intermediate shaft 13*b* is connected to the output shaft of the rotary actuator 13*a* whereas its other end is connected to one end of a stopper arm 13*d* whose other end is threadedly coupled to a stopper member 13*e* so that it may be adjustably displaceable in parallel to the axis of the plate cylinder PC.

Accordingly, by operating the rotary actuator 13*a*, the intermediate shaft 13*b*, the stopper arm 13*d* and the stopper member 13*e* will be integrally operated so that they may be displaced between a region in which they are opposed to the peripheral surface of the plate cylinder PC and a region in which they are otherwise.

As shown in FIG. 7, when the plate cylinder herein is constituted by the plate cylinder PC whose right-hand side portion PC1 and left-hand side portion PC2 are separately displaceable about their center in their axial directions, there are provided a pair of the stop position determining means 13 and 13 at both the end portions of the afore-mentioned printing plate support bar 11*d*, respectively. Then, the site at which the plate cylinder PC is supported is detected by the sensing means not shown and a particular operating one of the pair of the stop position determining means 13 is selected in conjunction with the direction of the operation of the piston rod of the afore-mentioned hydraulic cylinder 11*e* determined in accordance with a particular result of the detection. See FIGS. 1A, 1B, 4, 5 and 7.

The printing plate displacement means 2 in the embodiment shown in FIG. 1A is designed to attract and retain, upwardly of the afore-mentioned printing plate support means 1, a printing plate PP supported thereby, while arranging the attracted and retained printing plate PP so as to be displaceable towards the plate cylinder PC with the one lock-up hook portion PP1 set free. See FIG. 1A, 3 and 6.

More specifically, the afore-mentioned sub-frames SF and SF (details with respect to the sub-frame at one side only are shown in the drawings while ones at the other side are omitted therein) have secured thereto at suitable opposing sites thereof a pair of guide rails 21*a* and 21*a*, respectively, which are arranged in parallel to a plane that contains the reference site 11*f* of the printing plate support bar 11*d* of the afore-mentioned printing plate support means 1 and is in contact with the plate cylinder PC. A displacement member 21*b* is secured to each guide rail 21*a* in order to be displaced therealong and has secured thereto a bracket 21*d* via a block member 21*c*. See FIG. 3.

Figure 3:
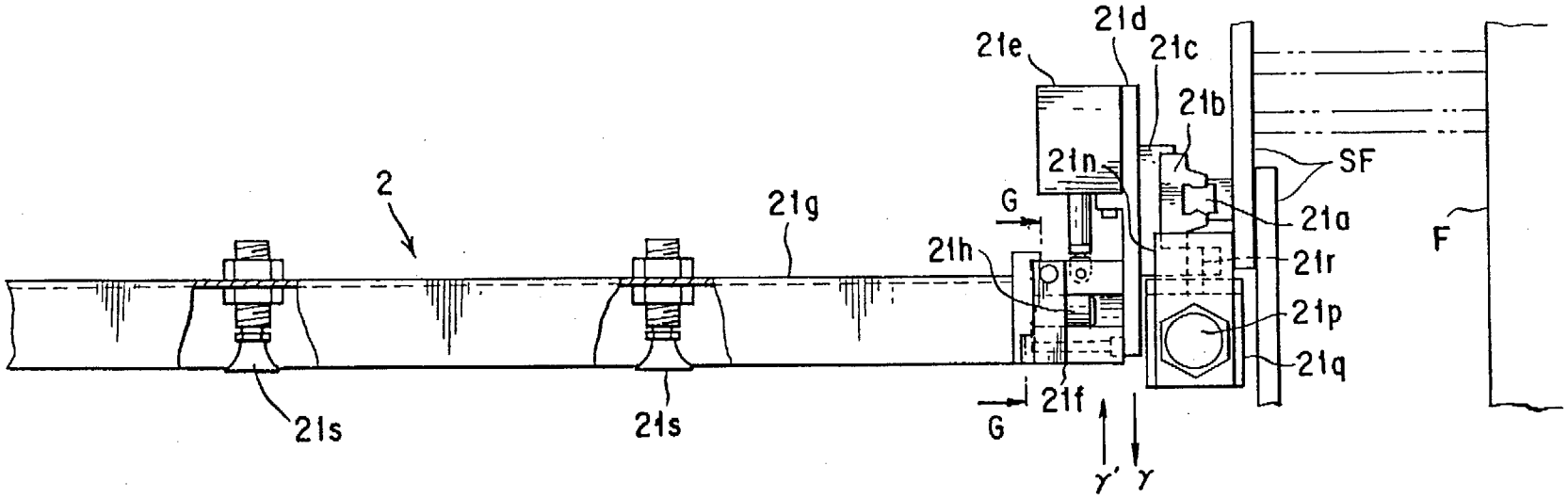
FIG. 3 is a diagrammatic view illustrating a portion of the embodiment as seen in the direction shown by the arrow C in FIG. 1A.

Also, secured to the bracket 21*d* is a hydraulic cylinder 21*e* which is so constructed that its piston rod may be driven in the directions that are as shown by the arrows γ and γ' in FIGS. 1A and 3, respectively, and that are orthogonal to the direction of a displacement of the afore-mentioned displacement member 21*b*. The frontal end of the piston rod of the hydraulic cylinder 21*e* is connected to a stay support block 21*f*.

The stay support block 21f is designed to hold a supporting shaft member 21*h* and to support a sucker member stay 21*g* by means of a cross-sectionally U-shaped groove 21*i* for accepting the afore-mentioned supporting shaft member 21*h* at the respective end of the sucker support stay 21*g* and a cap 21*j* for closing the opening portion of the afore-mentioned cross-sectionally U-shaped groove 21*i*. The afore-mentioned cap 21*j* has one end which is connected to the stay support block 21*f* by a rotary shaft 21*k* and the other end which can be fastened to the stay block 21*f* by a bolt 21*m*. See FIG. 6.

On the other hand, the afore-mentioned sub-frame SF has attached thereto a magnet-type rodless hydraulic cylinder 21*p* via a pair of brackets 21*n* and 21*n* so that an external displacement member 21*q* may be operatively moved in the directions as shown by the arrows δ and δ' in FIG. 1A, respectively. The external displacement member 21*q* of the magnet-type rodless hydraulic cylinder 21*p* and the afore-mentioned block 21 are coupled together by a pin 21*r*.

Accordingly, by operating the magnet-type rodless hydraulic cylinder 21*p*, the block member 21*c*, the bracket 21*d*, the hydraulic cylinder 21*e*, the stay support block 21*f* and the sucker support stay 21*g* will be integrally displaced along the guide rail 21*a* in the directions as shown by the arrows δ and δ' in FIG. 1A. The afore-mentioned sucker support stay 21*g* has attached thereto a plurality of suckers 21*s*, 21*s*, . . . , 21*s* which are arranged so that a plurality of sites of the plate cylinders may be attracted in front of and in the vicinity of the surface of a printing plate PP supported by the afore-mentioned printing plate support means 1. The suckers 21*s*, 21*s*, . . . , 21*s* are communicated to a suction source (not shown) via suitable valves (not shown).

Also, there is provided a suitable sensing means (not shown) for confirming a completion of the displacement operation of the sucker support stay 21*g* and detecting a completion of the suction retention operation of a printing plate PP by means of suckers 21*s*, 21*s*, . . . , 21*s*.

The printing plate press means 3 of the embodiment shown in FIG. 1A is provided so as to lie upwardly of the plate cylinder PC and in front of the periphery thereof and to be capable of abutting on the periphery of the plate cylinder PC in a predetermined area. See FIGS. 1A, 2 and 6.

More specifically, the afore-mentioned sub-frames SF and SF (details with respect to a sub-frame on one side only are shown in the drawings and those having the same construction on the other side are omitted therein) have secured thereto at suitable opposing sites thereof a pair of parallel guide rails 31*a* and 31*a* which are arranged in parallel to the guide falls 21*a* and 21*a* of the printing plate displacement means 2, respectively. Mounted on each guide rail 31*a* is a displacement member 31*b* which is designed to be displaced therealong. This displacement member 31*b* has secured thereto a bracket 31*d* via a block member 31*c*.

Figure 2:
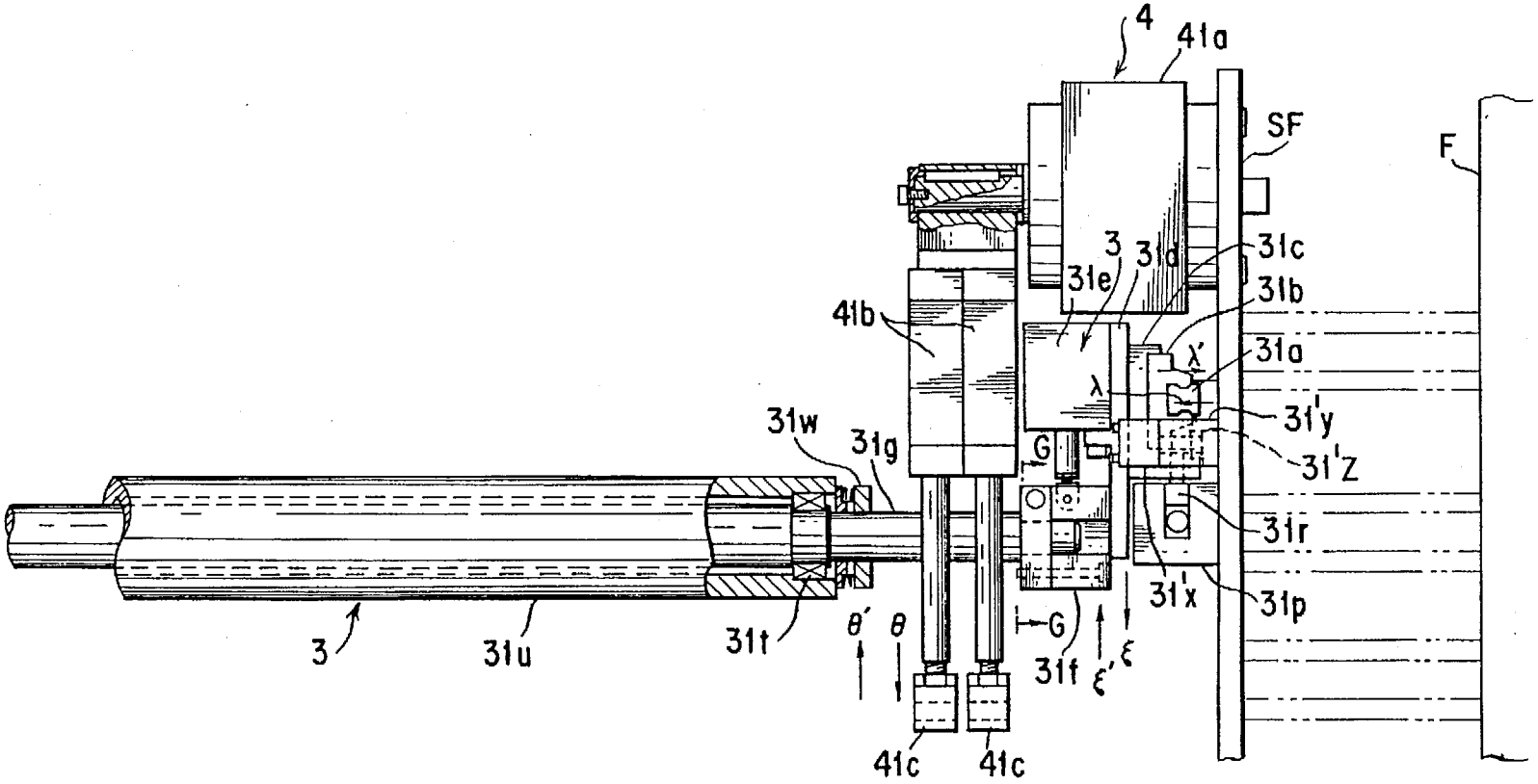
FIG. 2 is a diagrammatic view illustrating a portion of the embodiment as seen in the direction shown by the arrow B in FIG. 1A.

Also, the bracket 31*d* has secured thereto a hydraulic cylinder 31*e* which is so constructed that its piston rod may operatively be displaced in the directions that are as shown by the arrows ξ and ξ', respectively, in FIGS. 1A and 2 and that are orthogonal to the direction of a displacement of the aforementioned displacement member 31*d*. The frontal end of the piston rod of the hydraulic cylinder 31*e* is connected to a roller support block 31*f*.

The roller support block 31*f* is designed to retain and support the aforementioned roller shaft 31*g* by means of a cross-sectionally U-shaped groove 31*i* of which a pair arranged at both sides, respectively, are adapted to accept the both ends of the roller shaft 31*g*, respectively, and a cap 31*j* which is adapted to close the cross-sectionally U-shaped groove 31*i*. The afore-mentioned cap 31*j* has one end is coupled to the roller support block 31*f* by a rotary shaft 31*k* and the other end which can be fastened to the roller support block 31*f* by a bolt 31*m*. See FIG. 6.

On the other hand, the afore-mentioned frame SF has secured thereto a hydraulic cylinder 31*p* which is so constructed that its piston rod may operatively be displaced in the directions as shown by the arrows ϵ and ϵ', respectively, in FIG. 1A in parallel to the guide rail 31*a*. The frontal end of the piston rod of the hydraulic cylinder 31*p* and the afore-mentioned block member 31*c* are coupled together by a pin 31*r*.

Accordingly, by operating the hydraulic cylinder 31*p*, the block member 31*c*, the bracket 31*d*, the hydraulic cylinder 31*e*, the roller support block 31*f* and the roller shaft 31*g* are integrally displaced in the arrow directions ϵ and ϵ' along the guide rail 31*a*.

Also, the sub-frame SF has attached thereto a pair of hydraulic cylinders 31*x* and 31'*x* via brackets 31*y* and 31'*y*, respectively. The hydraulic cylinders 31*x* and 31'*x* are so constructed that their respective piston rods may operatively be displaced in the directions that are as shown by the arrows λ and λ', respectively, in FIG. 2 and that are orthogonal to the attachment surface of the sub-frame SF, and may be directed to the side of the latter. The frontal ends of these piston rods have secured thereto a pair of intermediate stoppers 31*z* and 31'*z*, respectively.

These intermediate stoppers 31*z* and 31'*z* are positioned at both side portions, respectively, across the direction of a displacement of the block member 31*c* of the printing plate press means 3 along the guide rail 31*a*, and are shifted to inside and outside of the displacement zone of the block member 31*c* in accordance with the operations of the hydraulic cylinders 31*x* and 31'*x*.

More specifically, when the intermediate stopper 31'*z* at the arrow E directional side (the right-hand side in the Figure) is displaced away from the sub-frame SF by a retraction of the piston rod of the hydraulic cylinder 31'*x*, the end surface of this intermediate stopper 31'*z* will be brought into contact with the block member 31*c* displacing in the arrow ϵ direction to cause it to be stopped at an intermediate site. Also, when the intermediate stopper 31*z* at the arrow ϵ directional side (the left-hand side of the Figure) is similarly displaced, the end surface of this intermediate stopper 31*z* will be brought into contact with the block member 31*c* displacing in the arrow ϵ direction to cause it to be stopped at an intermediate site.

In this connection, it should be noted that these both intermediate sites are each an identical site which constitutes a position that corresponds to the printing plate lock-up means PL of the plate cylinder PC as will be described later herein.

On the other hand, the afore-mentioned roller shaft 31*g* has rotatably mounted thereon, via a bearing 31*t*, a roller member 31*u* whose periphery is juxtaposed with the periphery of the plate cylinder PC and brought into and out of contact therewith. The roller shaft has also mounted thereon a control mechanism 31*w* having a member which is energized by a suitable energizing means to come into contact with a side end surface of the afore-mentioned roller member 31*u* for controlling the rotation thereof. The control mechanism 31*w* may be mounted on either one or both of the two opposing sides of the roller member 31*u*.

Also, although not shown, there are provided suitable sensing means for detecting a completion of each displacement operation of the roller member 31*u* and for detecting a completion of each displacement operation of the intermediate stopper 31*z* or 31'*z*.

The printing plate lock-up operating means 4 of the embodiment shown in FIG. 1A is designed to operate the printing plate lock-up means PL for the plate cylinder PC and is provided at a predetermined site, that is, in the vicinity of the printing plate lock-up means PL for the plate cylinder PC which is stopped in a phase of rotation in which the printing plate lock-up means PL matches with a site of contact of the plane lying in contact with the plate cylinder PC in the explanation of the afore-mentioned printing plate displacement means 2. It is constructed in accordance with the construction of the printing plate lock-up means PL. See FIGS. 1A and 2.

At this point, it may be desirable to make a brief explanation with respect to the printing plate lock-up means PL in the embodiment shown in FIGS. 1A and 1C. The printing plate lock-up means here comprise: an edge EG of a groove GV that is opening to the periphery of the plate cylinder PC and that extends in parallel to the axis thereof; a hook member HK that is disposed so as to be rotatable within the groove GV; an operating member HL that is provided at a side of the plate cylinders PC by being attached to a hook member HK so as to enable the latter to be displaceably operated; and a stopper member ST whose top portion is protruded by being passed through a slit SL that is provided in the operating member HL while being energized by a compression spring SP normally to displace towards the side as shown by the arrow ι in FIG. 1A and pressing with its jaw the edges of the afore-mentioned slit SL to restrict the displacement of the operating member HL. It is so arranged that the afore-mentioned displacement towards the arrow ι directional side may be stopped in a predetermined phase by a suitable member not shown. See FIGS. 1A, 1C and 7.

Thence, referring to the printing plate lock-up operating means 4, the afore-mentioned sub-frame SF and SF (details with respect to a sub-frame at one side only are shown in the drawings and those similarly configured at the other side are omitted therein for the sake of clarity) are provided at their respective, opposing sites with a pair of rotary actuators 41*a* and 41*a*, respectively, each of whose output shafts has secured thereto a pair of hydraulic cylinders 41*b* and 41*b* each with a piston rod which is capable of being extended and retracted in the respective directions as shown by the arrows θ and θ', respectively, in FIG. 1A and 2.

The frontal end of each of the respective piston rods of the hydraulic cylinders 41*b* and 41*b* has secured thereto a subsidiary operating member 41*c* which has a recessed portion engageable with the operating member HL of the afore-mentioned printing plate lock-up means PL and capable of displaceable operation for the said operating member HL and a stopper abutting portion that can be brought into contact with the stopper member ST for displacing the latter against the energizing force of the compression spring SP.

Also, though not shown, there is provided a suitable sensing means for detecting a completion of each displacement operation of the subsidiary operating member 41*c*.

In connection of the above, it should also be noted that the hydraulic cylinders 41*b* and the subsidiary operating members 41*c* are the same in number to the number of operating members HL of the printing plate lock-up means PL. In the embodiment illustrated in FIGS. 1A and 7, the hook member HK are divided into a pair of members (not shown) provided respectively in a pair of the printing plate lock-up means PL for the right-hand side member PC1 and the left-hand side member PC2, respectively, of the plate cylinder PC. There are thus provided a pair of operating members ill so that the two hook members HK may be operated individually and separately. In the embodiment shown in FIGS. 1A and 2, a pair of the operating members HL and HL are provided for each individual sub-frame SF side.

Now, referring to FIGS. 8 and 9, the operation of the foregoing embodiment of the present invention will be discussed in detail hereinbelow. In this connection, it should be noted that the operation set forth below will be described as proceeding sequentially with a sequence controller (not shown) which is responsive to detection output signals that are derived from sensing means (not shown) each of which is adapted to detect a completion of each individual operation. Nevertheless, it should be noted that it may be designed otherwise, e.g. as proceeding with a programmable controller responsive to other suitable sensing means.

First, the lock-up operation for the printing plate is set out below. See FIG. 8.

First of all, the plate cylinder PC will be rotated and then will be stopped in a predetermined phase of rotation (step 1).

Subsequently, a printing plate PP will be mounted by a manual operation or suitable means (not shown) on the printing plate support bar 11*d* of the printing plate support means 1. In this mounting step, one lock-up hook portion PP1 for the printing plate PP will be hooked at the reference site 11*f* of the printing plate support bar 11*d* so as to be defined in parallel to the axis of the plate cylinder PC, while the positioning engagement portion PP3 provided in the one lock-up hook portion PP1 will be fitted with the receiving position determining means 12 that is provided at the reference site 11*f* corresponding to the respective printing plate lock-up positions for the right-hand side portion PC1 and the left-hand side portion PC2 of the plate cylinder PC. As a result, the printing plate PP will be positioned at a predetermined site of the printing plate support bar 11*d*(step 2).

Subsequently, based upon a detection result for the printing plate PP mounting position which result is derived from a sensing means (not shown), the hydraulic cylinders 11*e* and 11*e* will be operated to displace the printing plate support bar 11*d* in parallel to the axis of the plate cylinder PC. More specifically, when a hydraulic cylinder 11*e* is secured to the sub-frame SF at the right-hand side and the printing plate PP is supported corresponding to the right-hand side portion PC1 of the plate cylinder PC, the piston rod of the hydraulic cylinder 11*e* will operatively be retracted to displace the printing plate support bar 11*d* in a direction as shown by the arrow α in FIGS. 4 and 7. When the printing plate PP is supported corresponding to the left-hand side portion PC2 of the plate cylinder PC, the piston rod of the hydraulic cylinder 11*e* will be operatively extended to displace the printing plate support bar 11*d* in a direction as shown by the arrow α' in FIGS. 4 and 7.

Subsequently, the output shaft of the rotary actuator 13*a* will be operated in a direction as shown by the arrow β in FIG. 1A to rotate the stopper arm 13*d* so as to displace the stopper member 13*e* from a position where it is not opposed to a side end surface of the plate cylinder PC to a position where it is opposed to the side end surface of the plate cylinder PC. With respect to the rotary actuators 13*a* and 13*a* operating in this displacement, the right-hand side rotary actuator 13*a* will be operated when the printing plate PP is supported so as to correspond to the right-hand side portion PC1 of the plate cylinder PC, whereas the left-hand side rotary actuator 13*a* will be operated when the printing plate PP is supported so as to correspond to the left-hand side portion PC2 of the plate cylinder PC.

In this connection, it should be noted that the stopping of the afore-mentioned plate cylinder PC in a predetermined phase of rotation may have been completed by the point of this time.

Figure 10:
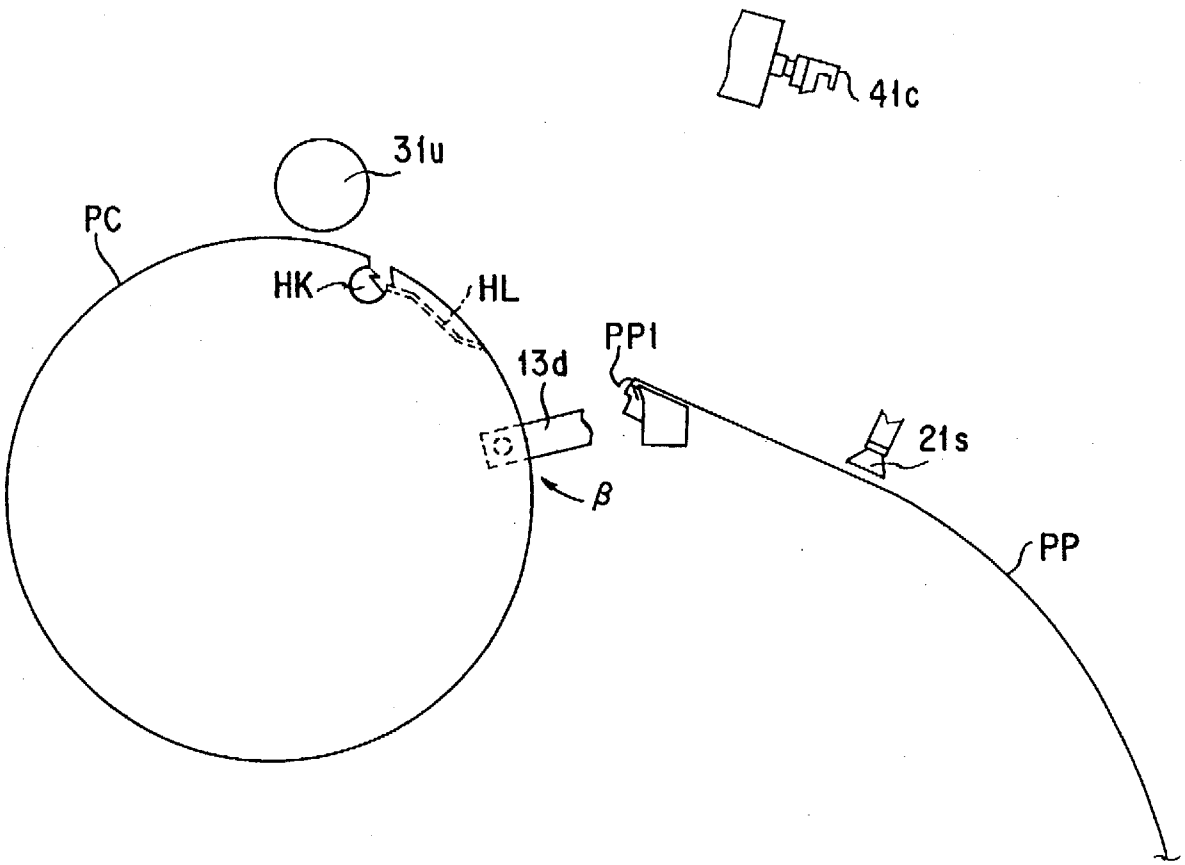
FIG. 10 is an operational diagrammatic view illustrating a state in which the plate cylinder is supported by a printing plate support bar which is positioned relative to the plate cylinder in the axial direction.

Subsequently, the hydraulic cylinder 11*e* will be operated in a sense opposite to that mentioned above. By this operation, the stopper member 13*e* which has been displaced at the position at which it is juxtposed with the side end surface of the plate cylinder PC will be displaced along with a displacement of the printing plate support bar 11*d* so as to come into contact with the side end surface of the plate cylinder PC with which it has been opposed. By this contacting action, the displacement of the printing plate support bar 11*d* will be caused to stop so that the printing plate support bar 11*d* may be brought into a predetermined phase relationship either with the right-hand side portion PC1 of the plate cylinder PC or with the left-hand side portion PC2 thereof. Accordingly, the printing plate PP which has been mounted at the predetermined position on the printing plate support bar 11*d* will positioned to take a predetermined phase relationship either with the right-hand side portion PC1 of the plate cylinder PC or with the left-hand side portion PC2 thereof. In this connection, it should be noted that a fine adjustment in the mentioned position determining step will be carried out by using the threaded coupling between the stopper member 13*e* and the stopper arm 13*d* so as to adjust the amount of projection of the stopper member 13*e* (step 3). See FIG. 10.

Subsequently, the piston rod of the hydraulic cylinder 21*e* will be operated in a direction as shown by the arrow γ in FIGS. 1A and 3 so that the suckers 21*s*, . . . , 21*s* may be displaced via a sucker support stay 21*g* to come into contact with the printing plate PP and be operated thereby to attract and retain the printing plate PP by way of their sucking actions.

When the suckers 21*s*, . . . , 21*s* attract and retain the printing plate PP, the external displacement member 21*q* of the magnet-type rodless hydraulic cylinder 21*p* will be operated in a direction as shown by the arrow δ in FIG. 1A to displace the sucker support stay 21*g* along the guide rail 21*a* so as to displace the printing plate PP attracted and retained by the suckers 21*s*, . . . , 21*s* and feed it out towards the plate cylinder PC, thereby bringing the one lock-up hook portion PP1 of the printing plate PP in front of the opening portion of the the groove GV of the printing plate lock-up means PL.

Also, after the positioning engagement portion PC3 of the printing plate PP is made out of engagement with the receiving position determining means 12 by way of the aforementioned printing plate feed-out displacement, the piston rod of the hydraulic cylinder 11*e* of the printing plate support means 1 will be operated so as to move the stopper member 13*e* away front the side end surface of the plate cylinder PC. Further, the output shaft of the rotary actuator 13*a* will be rotated in a direction as shown by the arrow β' in FIG. 1A, thereby displacing the stopper member 13*e* to a position at which it is not opposed to the side end surface of the plate cylinder PC (step 4).

Subsequently, the piston rod of the hydraulic cylinder 31*p* of the printing plate press means 3 will be operated in a direction as shown by the arrow ε in FIG. 1A to be stopped at its stroke end.

Subsequent to this, the piston rod of the hydraulic cylinder 31*e* will be operated in a direction as shown by the arrow ξ in FIGS. 1A and 2 so that the roller member 31*u* may press a region of the one lock-up engagement portion PP1 of the printing plate PP against the periphery of the plate cylinder PC.

Subsequently, the piston rod of the hydraulic cylinder 31*x* will be displaced in a direction as shown by the arrow λ in FIG. 2 so as to locate the intermediate stopper 31*z* within a displacement region of the block member 31*c*.

Figure 11:
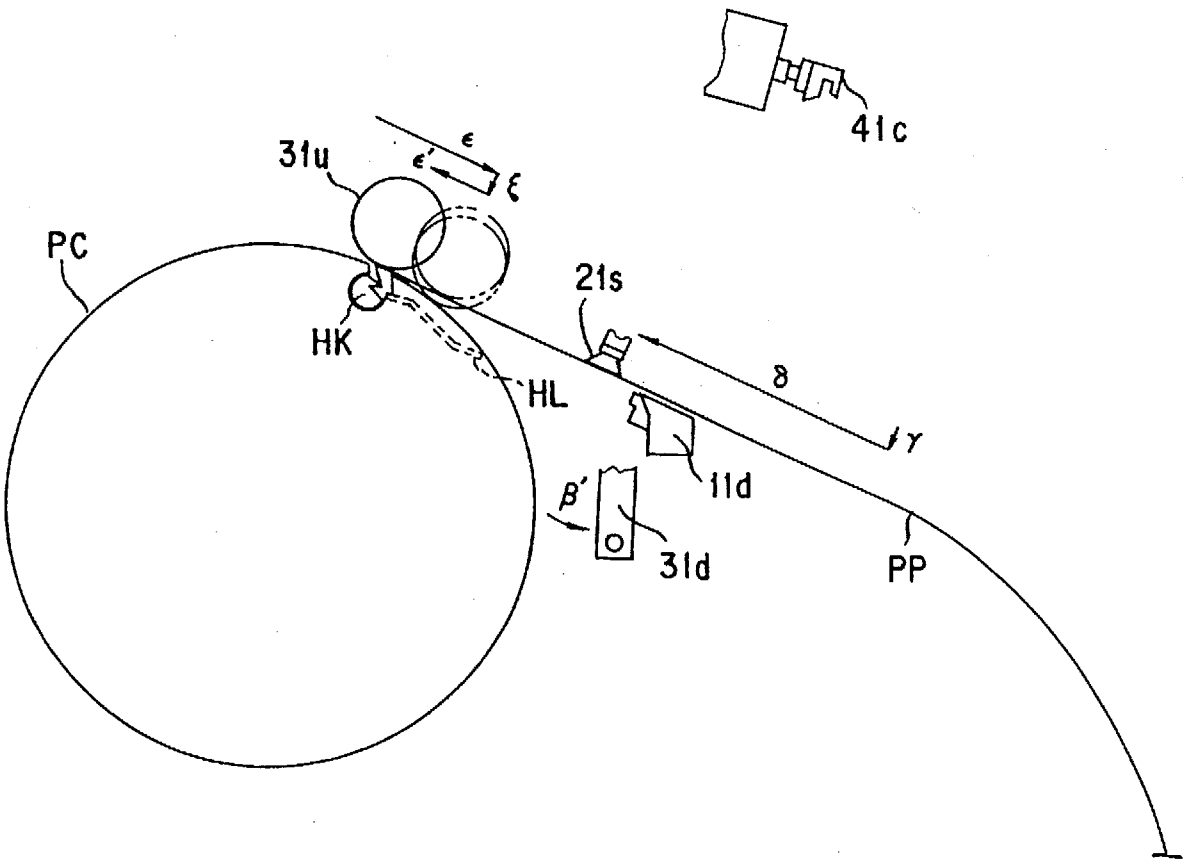
FIG. 11 is an operational diagrammatic view illustrating a state in which the printing plate is displaced to the side of the plate cylinder.

Subsequently, the piston rod of the hydraulic cylinder 31*p* will be operated in a direction as shown by the arrow ε' in FIG. 1A so that the block member 31*c* and the intermediate stopper 31*z* may be brought into contact with each other and will then be stopped. While this operation is being carried out, the roller member 31*u* will be rotated with the printing plate PP kept pressed thereby and will arrive at the position of the afore-mentioned one lock-up engagement portion PP1 to thrust the one lock-up hook portion PP1 into the afore-mentioned groove GV. See FIG. 11.

Subsequently, the external displacement member 21*q* of the magnet-type rodless hydraulic cylinder 21*p* will be operated in a direction as shown by the arrow δ' in FIG. 1A so that the suckers 21*s*, . . . , 21*s* may, while slightly returning back the printing plate PP, be displaced and may thereafter terminate their sucking actions. Also, while being matched with the operation of this magnet-type rodless hydraulic cylinder 21*p*, the piston rod of the hydraulic cylinder 31*p* will be operated in a direction as shown by the arrow E in FIG. 1A until it reaches to its stroke end, will be rotated with the printing plate PP kept pressed by the roller member 31*u* against the periphery of the plate cylinder PC and will be displaced in the direction of the printing plate support means 1 (step 5).

By way of a series of these operations, it follows that the one lock-up hook portion PP1 of the printing plate PP will be hooked on one edge EG of the groove GV of the printing plate lock-up means PL for the printing plate PP.

Figure 12:
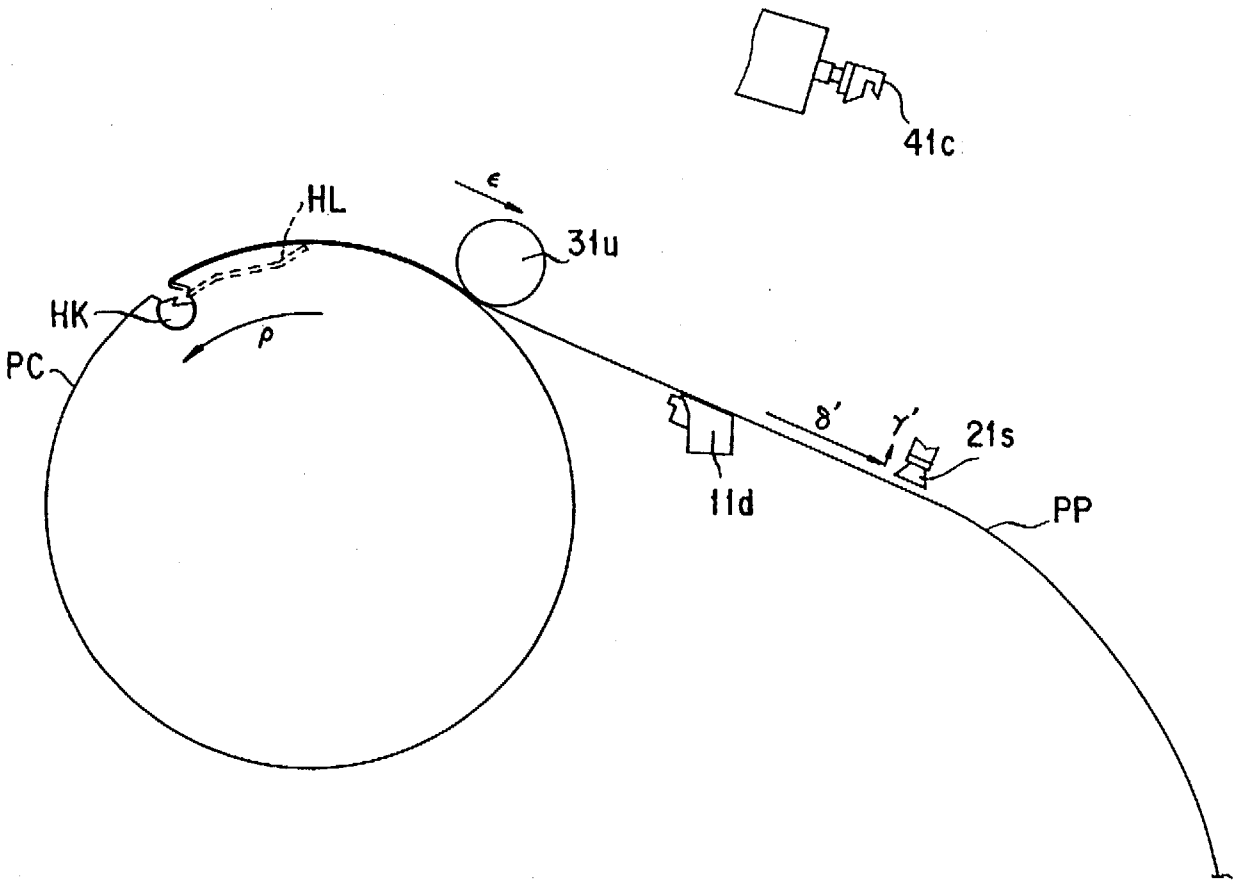
FIG. 12 is an operational diagrammatic view illustrating a state in which the printing plate is wound round the plate cylinder.

Subsequently, the plate cylinder PC will be rotated in a regular fashion (i.e. rotated in a direction as shown by the arrow ρ in FIG. 1A) so that the one lock-up hook portion PP1 of the printing plate may be advanced by the edge EG so as to wind the printing plate PP round the periphery of the plate cylinder PC (step 6). See FIG. 12.

While the printing plate PP is being wound round the periphery of the plate cylinder PC by the rotation of the plate cylinder PC in the regular direction, the piston rod of the hydraulic cylinder 31*x* will first be displaced in a direction as shown by the arrow λ' in FIG. 2 so that the intermediate stopper 31*z* may be positioned out of the displacement region of the block 31*c*. Subsequently, the piston rod of the afore-mentioned hydraulic cylinder 31*p* will be operated in a direction as shown by the arrow ε' in FIG. 1A until it reaches to its stroke end so as to change the position of the roller member 31*u* relative to the plate cylinder PC. In the meantime, the printing plate PP will be kept continuously pressed by the roller member 31*u* against the plate cylinder PC.

When the plate cylinder PC is rotated and then its phase of rotation reaches a predetermined phase of rotation, it will be stopped. At the time when the plate cylinder PC is stopped, the roller member 31*u* of the printing plate press means 3 will be pressing the region of the other lock-up hook portion PP2 of the printing plate PP (step 7).

Figure 13:
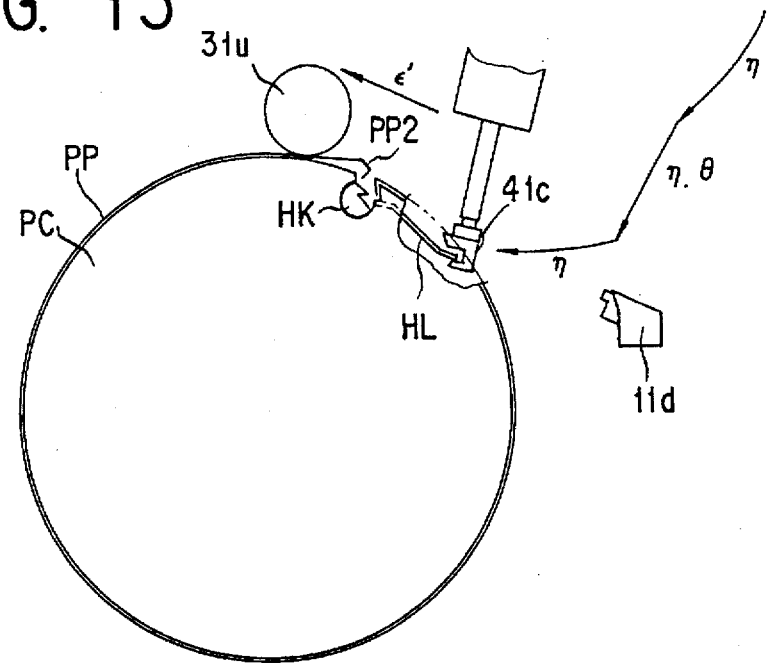
FIG. 13 is an operational diagrammatic view illustrating a printing plate lock-up operation of a printing plate lock-up means.

Next, the output shaft of the rotary actuator 41*a* of the printing plate lock-up operating means 4 will be operated in a direction as shown by the arrow η in FIG. 1A so as to displace the hydraulic cylinders 41*b* and 41*b* to their operating positions shown by the solid lines. Also, concurrently with this operation of the rotary actuator 41*a*, each of the respective piston rods of the hydraulic cylinders 41*b* and 41*b* will be operated in a direction as shown by the arrow θ in FIG. 2. As a displacement is made by this operation, the subsidiary operating members 41*c* and 41*c* attached respectively to the respective frontal ends of these piston rods will capture with their respective recessed portions the operating members HL and HL, respectively, of the printing plate lock-up means PL of the plate cylinder PC, and will cause their respective upper projections constituting those recessed portions to abut on the stopper members ST and ST to displace the stopper members ST and ST against the energizing forces of the compression springs SP and SP, respectively, thereby releasing the restriction on the displacements of the operating members HL and HL with the jaw portions of the stopper members ST and ST, respectively (step 8). See FIG. 13.

Subsequently, the respective piston rods of the hydraulic cylinders 41*b* and 41*b* will be operated each in a direction as shown by the arrow θ' in FIGS. 1A and 2 so as to pull up the operating portions HL and HL with downward projections constituting the recessed portions of the subsidiary operating members 41*c* and 41*c*, respectively, to displace the hook members HK and HK each in a direction as shown by the arrow κ in FIG. 1C, and to bring the hook members HK and HK in the hooking preparatory state in which they do not interfere with the other lock-up hook portion PP2 of the printing plate PP as thrusted into the groove GV.

Next, the piston rod of the hydraulic cylinder 31'*x* will be operated in a direction as shown by the arrow λ so as to locate the intermediate stopper 31'*z* within the displacement region of the block member 31*c*.

Figure 14:
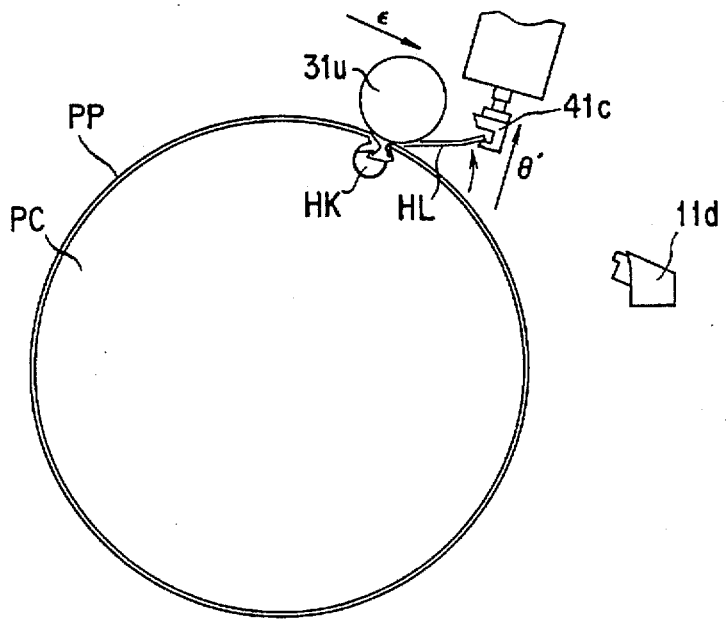
FIG. 14 is an operational diagrammatic view illustrating another printing plate lock-up operation of a printing plate lock-up means.

Subsequently, the piston rod of the hydraulic cylinder 31*p* will be operated in a direction as shown by the arrow ε in FIG. 1A so that the block member 31*c* and the intermediate stopper 31'*x* may be brought into contact with each other and will then be stopped. While this operation is being carried out, the roller member 31*u* will be rotated with the printing plate PP kept pressed thereby and will arrive at the position of the afore-mentioned other lock-up hook portion PP2 to thrust it into the afore-mentioned groove GV (step 9). See FIG. 14.

Next, the respective piston rods of the hydraulic cylinders 41*b* and 41*b* will be operated each in a direction as shown by the arrow θ in FIGS. 1A and 2 so as to press down the operating members HL and HL at the respective lower surfaces of the afore-mentioned projections of the subsidiary operating members 41*c* and 41*c* and to displace the stopper members ST and ST until their head portions are passed through the slits SL and SL of the operating members HL and HL, respectively.

As these operating members HL and HL are displaced, the hook members HK and HK will be displaced each in a direction as shown by the arrow κ' in FIG. 1C so as to cause the other lock-up hook portion PP2 of the printing plate PP to be hooked. The printing plate will thereby be locked up onto the plate cylinder PC.

Subsequently, the piston rod of the hydraulic cylinder 31*e* of the printing plate press means 3 will be operated in a direction as shown by the arrow ξ' in FIG. 1A, whereas the piston rod of the hydraulic cylinder 31'*x* will be operated in a direction as shown by the arrow λ' in FIG. 2, so as to return the printing plate press means 3 to its initial state.

Further, the output shaft of the rotary actuator 41*a* of the printing plate lock-up operating means 4 will be operated in a direction as shown by the arrow η' in FIG. 1A, whereas the respective piston rods of the hydraulic cylinders 41*b* and 41*b* will be operated each in a direction as shown by the arrow θ' in FIGS. 1A and 2, to return the printing plate lock-up operating means 4 to its initial state.

Figure 15:
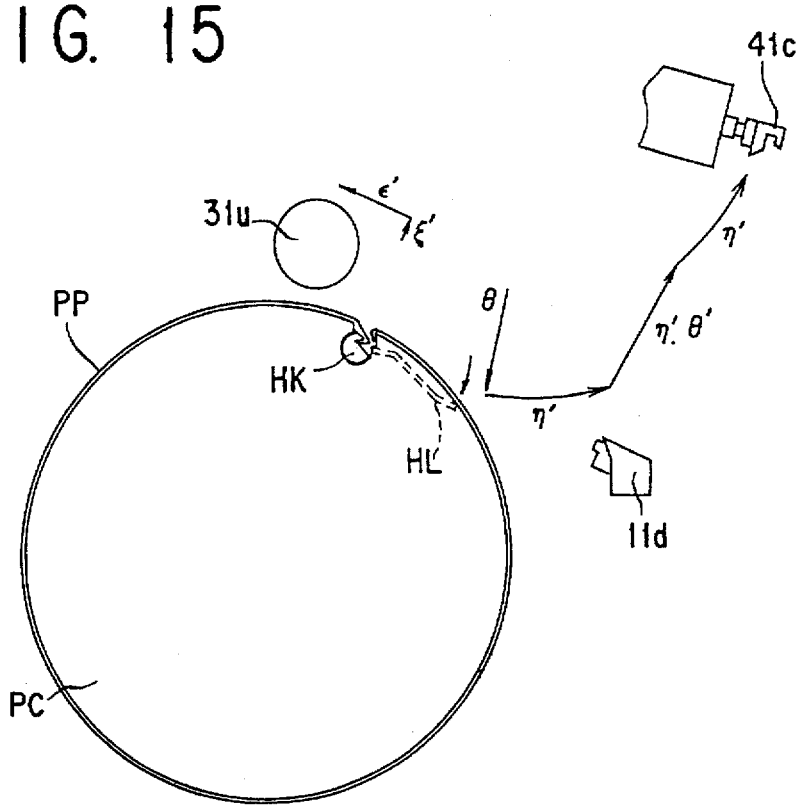
FIG. 15 is an operational diagrammatic view illustrating a state in which a printing plate lock-up operation is completed.

By way of this operation of the rotary actuator 41*a*, the respective protruding ends of the afore-mentioned upward projections of the subsidiary operating members 41*c* and 41*c* will be moved away from the stopper members ST and ST of the printing plate lock-up means PL, respectively, and the stopper members ST and ST will be displaced in parallel directions as shown by the arrow λ in FIG. 1A with the energizing forces of the compression springs, respectively while their respective jaw portions will restrict the displacements of the operating members HL and HL, respectively (step 10). See FIG. 15.

The detaching operation of the printing plate PP from the plate cylinder PC is set forth below. See FIG. 9.

First of all, the plate cylinder PC will be rotated and then will be stopped with a predetermined phase of rotation (step 11).

Next, the piston rod of the hydraulic cylinder 31*e* of the printing plate press means 3 will be operated in a direction as shown by the arrow ξ in FIGS. 1A and 2 so that the region of the other lock-up portion PP2 of the printing plate PP which has been locked up onto the periphery of the plate cylinder PC may be pressed against the periphery of the plate cylinder PC (step 12).

Next, the output shaft of the rotary actuator 41*a* of the printing plate lock-up operating means may be operated in a direction as shown by the arrow η in FIG. 1A so as to displace the hydraulic cylinders 41*b* and 41*b* each to the position shown by the solid lines in FIG. 1A. Also, concurrently with the operation of this rotary actuator 41*a*, the respective piston rods of the hydraulic cylinders 41*b* and 41*b* will be operated each in a direction as shown by the arrow θ in FIGS. 1A and 2. Then a displacement by this operation will cause the subsidiary operating members 41*c* and 41*c* attached respectively to the respective ends of these piston rods to capture the operating members HL and HL of the printing plate lock-up means PL with their recessed portions, respectively, and the respective protruding ends of the upward projections constituting these recessed portions to abut on the stopper members ST and ST of the printing plate lock-up means PL, respectively. The stopper members ST and ST will thus be displaced against the energizing forces of the compression springs SP and SP, respectively, thereby releasing the restriction on the controls in displacement of the operating members HL and HL effected with the jaw portions of the stopper members ST and ST, respectively. Subsequently, the respective piston rods of the hydraulic cylinders 41*b* and 41*b* will be operated each in a direction as shown by the arrow θ' in FIGS. 1A and 2 so as to pull down the operating members HL and HL with the afore-mentioned downward projections of the subsidiary operating members 41*c* and 41*c*, respectively, to displace the hook members HK and HK each towards a direction as shown by the arrow κ in FIG. 1C, and to bring the hook members HK and HK into the hooking preparatory state.

Figure 16:
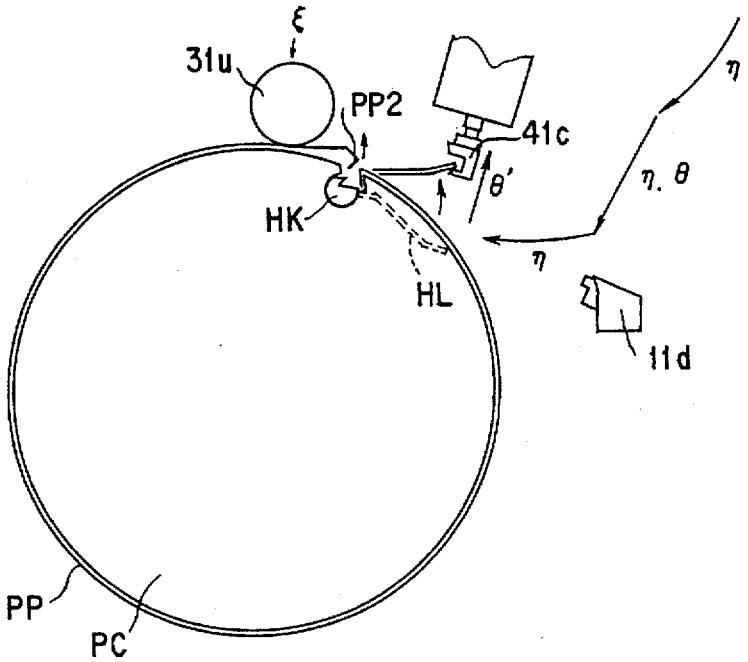
FIG. 16 is an operational diagrammatic view illustrating a printing plate removal operation for a printing plate lock-up means.

By way of the preceding action, the hooking of the afore-mentioned other lock-up hook portion PP2 of the printing plate PP with the hook members HL and HL will be released, and this other lock-up hook portion PP2 will be leaped up by the elasticity of the printing plate PP so that it may be led out from the groove GV (step 13). See FIG. 16.

Next, the respective piston rods of the hydraulic cylinders 41*b* and 41*b* will be operated each in a direction as shown by the arrow θ in FIGS. 1A and 2 so as to push up the operating members HL and HL at the respective lower surfaces of the afore-mentioned upward projections of the subsidiary operating members 41*c* and 41*c*, respectively, and to displace the stopper members ST and ST until their respective top portions are passed through the slits SL and SL of the operating members HL and HL, respectively.

Subsequently, the rotary actuator 41*a* will be operated in a direction as shown by the arrow η' in FIG. 1A whereas the respective piston rods of the hydraulic cylinders 41*b* and 41*b* will be operated each in a direction as shown by the arrow θ' in FIGS. 1A and 2 so as to return the printing plate lock-up operating means 4 to its initial state (step 14).

Also, by way of this operation of the rotary actuator 41*a*, the respective protruding ends of the afore-mentioned upward projections of the subsidiary operating members 41*c* and 41*c* will be moved away from the stopper members ST and ST of the printing plate lock-up means PL, respectively, and the stopper members ST and ST will be displaced each in a direction as shown by the arrow ι in FIG. 1A to restrict the displacements of the operating members HL and HL with their jaw portions, respectively.

Figure 17:
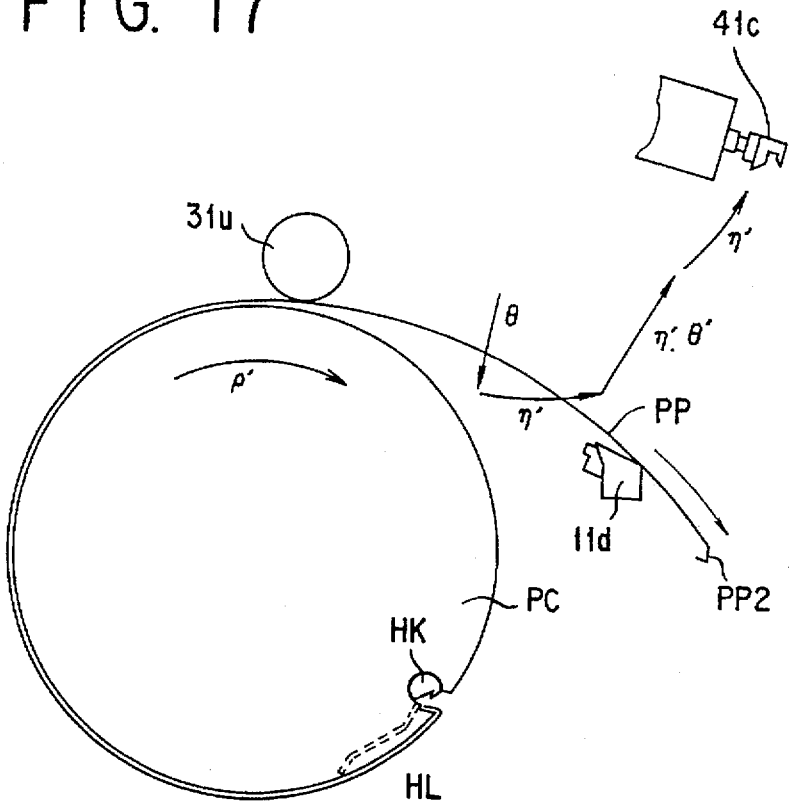
FIG. 17 is an operational diagrammatic view illustrating a printing plate removal operation for detaching a printing plate from a plate cylinder.

Next, the plate cylinder PC will be reversely rotated (in a direction as shown by the arrow ρ' in FIG. 1A so that the printing plate PP may be gradually removed away from the periphery of the plate cylinder PC and that the afore-mentioned other lock-up hook portion PP2 existing at its leading end may arrive at the printing plate support bar 11*d* of the printing plate support means 1 and may then be guided by the printing plate support bar 11*d* to an outlet side (step 15). See FIG. 17.

Subsequently, a suitable timing is taken to operate the piston rod of the hydraulic cylinder 31*e* of the printing plate press means 3 in a direction as shown by the arrow ρ' in FIGS. 1A and 2 so that the printing plate press means 3 may be returned to its initial state (step 16). In the meantime, the plate cylinder PC will continue to be rotated reversely.

Figure 18:
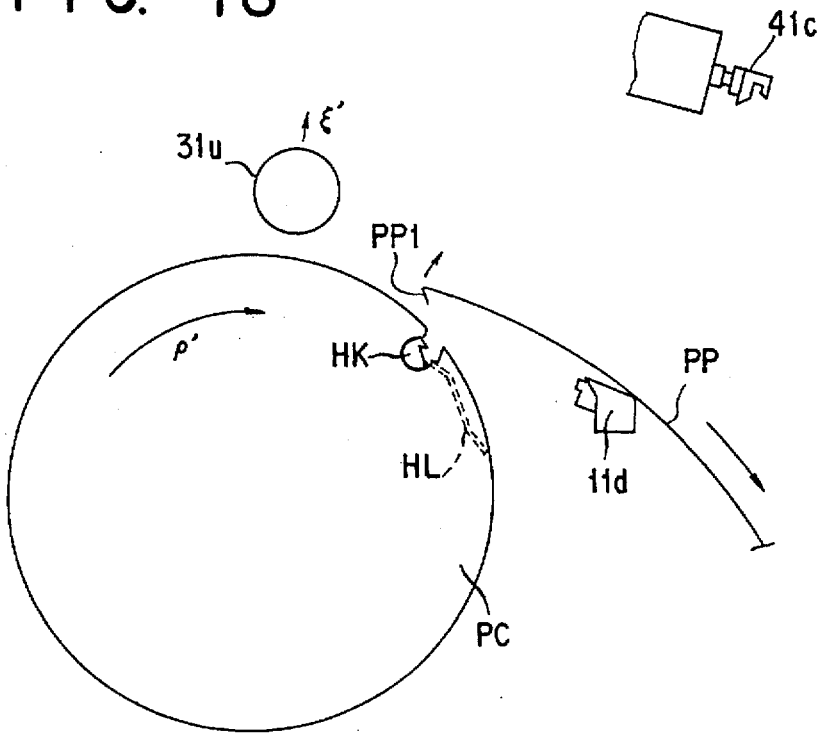
FIG. 18 is an operational diagrammatic view illustrating another printing plate removal operation for detaching a printing plate from a plate cylinder.

After the plate cylinder PC is further rotated reversely to exceed one revolution thereof, and by the time when the phase of rotation is reached at which the printing plate lock-up means PL is shifted below the printing plate support bar 11*d* of the printing plate support means 1, a force will be acted upon the afore-mentioned one lock-up hook portion PP1 of the printing plate PP in a direction such that it may be hooked off from the one edge EG of the groove GV (step 17). See FIG. 18.

In connection with the above, it should be noted that in the foregoing explanations of the printing plate mounting and detaching (removal) operations set forth above, mention has been made to such operations in which a pair of the operating members HL and HL of the printing plate lock-up means PL for the plate cylinder PC are simultaneously operated. In case, however, where only either one of the operating members HL is to be operated, it will suffice that only a single hydraulic cylinder 41*b* alone that is provided corresponding to the operating member HK being operated may be operated in conjunction with the operation of the afore-mentioned printing plate lock-up operating means 4.

Although the present invention has been illustrated and described with respect to exemplary embodiments thereof, it should be understood by a person skilled in the art that the foregoing and other various changes, omissions and additions may be made therein, therefrom and thereto, without departing from the spirit and scope of the present invention. Therefore, the present invention should not be understood as limited to the specific embodiments set out above but to include all possible embodiments which can be embodied within the scope encompassed and as equivalents thereof with respect to the features set forth in the appended claims.

From the foregoing description, it will be appreciated that the practice of the present invention in regard to a printing plate support device in a printing plate removably mounting apparatus has enabled a printing plate being locked up to be positioned with an extremely high precision and in an extremely short period of time, corresponding to a position where it is to be locked up onto a plate cylinder lying in an axially displaced state for any of the reasons which include a rough preliminary adjustment of the printing plate, and has enabled the printing plate to remain supported in such an excellent, highly precisely positioned state.

Also, in regard to a printing plate removably mounting apparatus according to the present invention, it will be appreciated that its operating mechanism has been extremely simplified as compared with any of those which have hitherto been proposed or practiced, and has been made extremely lighter than such those. Hence its operation has been extremely simplified, has required only an extremely reduced amount of operation and has been made extremely readily controllable.

Accordingly, it will also be appreciated that the manufacturing cost as well as the running cost can be extremely reduced according to the present invention. Further, by providing a printing plate removably mounting apparatus for each plate cylinder according to the present invention, it will also be appreciated that the times required for attaching a printing plate to and detaching it from a plate cylinder can be reduced, thus contributing to the enhancement of the rate of working of a printing press as well.

What is claimed is:

1. A rotary printing press system, comprising:

a plate cylinder that is displaceable in its axial direction, said plate cylinder being rotatable in both a normal drive direction and a reverse drive direction and being capable of being stopped in a predetermined phase of rotation, and said plate cylinder having a printing plate lock-up means formed on a periphery thereof and in parallel to its axis;

a printing plate formed with a plurality of lock-up hook portions for being hooked onto and off of said printing plate lock-up means; and an apparatus for removably mounting said printing plate on said plate cylinder, said apparatus comprising:

a printing plate support means disposed at a position along said plate cylinder and spaced from the periphery thereof by a predetermined distance for supporting said printing plate in a predetermined positional relationship with said plate cylinder such that a said printing plate lock-up hook portion lies in parallel to the axis of said plate cylinder and is matched with an axial displacement of said plate cylinder while mounting said printing plate on said plate cylinder in such a manner that the printing plate when detached therefrom can be guided towards an outlet direction;

a printing plate displacement means which is disposed in the vicinity of said printing plate supported on said printing plate support means for retaining said printing plate supported by said printing plate support means and for mounting said printing plate so as to freely advance at least one of said lock-up hook portions so that said printing plate can be fed out towards said plate cylinder along a surface generally in contact with said periphery of the plate cylinder;

a printing plate press means disposed in the vicinity and in front of the periphery of said plate cylinder for being displaced into and out of contact with said periphery of the plate cylinder, and for displacing a said printing plate lock-up hook portion towards said printing plate lock-up means for said plate cylinder and pressing said printing plate against said periphery of the plate cylinder to mount said printing plate to said plate cylinder by winding said printing plate around said plate cylinder with a rotation thereof; and a printing plate lock-up operating means disposed in the vicinity of said printing plate lock-up means for said plate cylinder and selectively operative upon a stoppage of said plate cylinder in said predetermined phase of rotation for operating said printing plate lock-up means to mount said printing plate with said hook portion hooked thereto on said plate cylinder while said plate cylinder is stopped in said predetermined phase of rotation.

2. A rotary printing press system as set forth in claim 1, in which said printing plate support means comprises:

a printing plate receiving means which is located at a position spaced from said periphery of said plate cylinder by a predetermined distance and is positioned relative to said plate cylinder to hold said lock-up hook portion of said printing plate in parallel to the axis of said plate cylinder and, when driven, is displaceable in a direction parallel to said axis of the plate cylinder;

a receiving position determining means which is engageable with a positioning engagement portion that is provided at a predetermined position of said lock-up hook portion of the printing plate mounted on said printing plate receiving means for positioning said printing plate at a predetermined position relative to said printing plate receiving means; and a stopping position determining means which is disposed at a side portion of said printing plate receiving means and is displaceable between a position that is opposed to a side end surface of said plate cylinder and a position that is otherwise, said stopping position determining means abutting said side end surface of the plate cylinder upon a displacement of said printing plate receiving means for stopping the printing plate receiving means at a preselected position relative to said plate cylinder.

3. A rotary printing press system as set forth in claim 2, further comprising a means for stopping said plate cylinder in a predetermined phase of rotation while said printing plate is supported on said printing plate support means as a result of said lock-up portion being defined in parallel to the axis of said plate cylinder and said position determining engagement portion disposed at a predetermined position of a said lock-up portion being engaged with a receiving position determining means disposed on said printing plate receiving means so as to be located at a predetermined position of said printing plate receiving means and mounted on the printing plate support means.

4. A rotary printing press system as set forth in claim 3, in which said printing plate displacement means has a means for holding said printing plate supported on said printing plate support means and then freely advancing at least one of said lock-up hook portions so as to feed out said printing plate by a predetermined amount towards said plate cylinder.

5. A rotary printing press system as set forth in claim 4, in which said printing plate displacement means has a means for feeding out said printing plate until said one lock-up hook portion is brought into a point of juxtaposition with said printing plate lock-up means for the plate cylinder that remains stopped with a said predetermined phase of rotation.

6. A rotary printing press system as defined in claim 5, wherein said printing plate press means provides a means for pressing said one lock-up hook portion of the printing plate towards said printing plate lock-up means, and further comprising a means for hooking said lock-up hook portion on said printing plate lock-up means by an interaction between a withdrawal operation by way of said printing plate displacement means and a displacement operation towards a suitable direction by way of said printing plate press means.

7. A rotary printing press system as set forth in claim 6, wherein said printing plate press means provides a means for pressing a portion of said printing plate against the peripheral surface of said plate cylinder to cause said printing plate to be wound around said plate cylinder by rotating said plate cylinder in a normal direction.

8. A rotary printing press system as set forth in claim 7, further comprising a means for stopping said plate cylinder having said printing plate wound therearound in a predetermined phase of rotation in which another of said lock-up portions of the printing plate is opposed to the printing plate lock-up means for hooking the same.

9. A rotary printing press system as set forth in claim 8, further comprising a means for operating said printing plate lock-up means when said plate cylinder is stopped for hooking said another lock-up hook portion of the printing plate into a preparatory hooking state in which said another lock-up portion can be hooked while said printing plate press means is displaced to press said another lock-up hook portion against said printing plate lock-up means.

10. A rotary printing press system as set forth in claim 9, wherein said printing plate lock-up operating means provides a means for operating said principal plate lock-up means, which is lying in a preparatory hooking state when said pressing operation is completed, so as to hook said another lock-up hook portion of the printing plate, thereby locking up said printing plate onto said plate cylinder.

11. A rotary printing press system as set forth in claim 1 or 2, further comprising a means for stopping said plate cylinder in a predetermined phase of rotation in which said printing plate lock-up means can be hooked off with one of said lock-up hook portions for the printing plate.

12. A rotary printing press system as set forth in claim 11, in which said printing plate is supported on said printing plate support means by said lock-up hook portion of said printing plate which extends paralled to the axis of the plate cylinder when said printing plate is located at a predetermined receiving position and mounted upon said printing plate support means.

13. A rotary printing press system as set forth in claim 1 or 2, further comprising a means for stopping said plate cylinder, when said printing plate is to be detached, in a predetermined phase of rotation in which said printing plate lock-up means for hooking said one of said lock-up hook portions of the printing plate can be operated by said printing plate lock-up operating means.

14. A rotary printing press system as set forth in claim 13, in which said printing plate press means provides a means for pressing those sites which are in the vicinity of said one lock-up hook portion of the printing plate against the peripheral surface of said plate cylinder while said printing plate lock-up means is operated by said printing plate lock-up operating means into a preparatory hooking state in the lock-up for said printing plate.

15. A rotary printing press system as set forth in claim 14, further comprising a means for releasing a hooking condition between the operated printing plate lock-up means and said lock-up hook portion, and for detaching said printing plate from the peripheral surface of said plate cylinder when said preparatory hooking state takes place.

16. A rotary printing press system as set forth in claim 15, further comprising a means for reversely rotating said plate cylinder to gradually detach said printing plate from said peripheral surface of the plate cylinder.

17. A rotary printing press system as set forth in claim 16, wherein an upper end of said printing plate support means provides a means for moving said printing plate detached from the peripheral surface of said plate cylinder, as said lock-up hook portion reaches said printing plate support means, away from said plate cylinder and for guiding said detached printing plate into an outlet direction.

* * * * *